US008608590B2

(12) United States Patent
Hackel et al.

(10) Patent No.: US 8,608,590 B2
(45) Date of Patent: Dec. 17, 2013

(54) ENGINEERED RESIDUAL STRESS IN GOLF CLUBS

(75) Inventors: Lloyd A. Hackel, Livermore, CA (US); Jon Rankin, Dublin, CA (US); Chanh H. Truong, Hayward, CA (US); C. Brent Dane, Livermore, CA (US); Fritz B. Harris, Jr., Rocklin, CA (US)

(73) Assignee: Metal Improvement Company, LLC, Paramus, NJ (US)

( * ) Notice: Subject to any disclaimer, the term of this patent is extended or adjusted under 35 U.S.C. 154(b) by 733 days.

(21) Appl. No.: 12/304,106

(22) PCT Filed: Jun. 14, 2007

(86) PCT No.: PCT/US2007/013993

§ 371 (c)(1),
(2), (4) Date: Nov. 4, 2010

(87) PCT Pub. No.: WO2007/146398

PCT Pub. Date: Dec. 21, 2007

(65) Prior Publication Data

US 2011/0045922 A1 Feb. 24, 2011

Related U.S. Application Data

(60) Provisional application No. 60/804,775, filed on Jun. 14, 2006.

(51) Int. Cl.
*A63B 53/04* (2006.01)

(52) U.S. Cl.
USPC ..... 473/342; 473/349

(58) Field of Classification Search
USPC ..... 473/324–350
See application file for complete search history.

(56) References Cited

U.S. PATENT DOCUMENTS

| | | | |
|---|---|---|---|
| 4,768,787 | A | 9/1988 | Shira |
| 5,029,865 | A | 7/1991 | Kim |
| 5,487,543 | A | 1/1996 | Funk |
| 5,945,157 | A | 8/1999 | Lee et al. |
| 6,309,309 | B1 | 10/2001 | Beach et al. |
| 6,623,376 | B2 | 9/2003 | Poynor |
| 6,818,854 | B2 | 11/2004 | Friedman et al. |
| 6,994,635 | B2 | 2/2006 | Poynor |
| 7,367,900 | B2 | 5/2008 | Kumamoto et al. |
| 2004/0192465 | A1 | 9/2004 | Erb et al. |

FOREIGN PATENT DOCUMENTS

WO WO-2004078278 9/2004

OTHER PUBLICATIONS

United States Golf Association "Procedure for Measuring the Flexibility of a Golf Clubhead" Rev. 2, Mar. 25, 2005, 9 pages.

*Primary Examiner* — Alvin Hunter
(74) *Attorney, Agent, or Firm* — Haynes Beffel & Wolfeld LLP

(57) ABSTRACT

A method of manufacturing a driver, or other types of golf club, includes inducing residual compressive stress by high intensity laser shock peening to form an array of laser shock peened impact zones on the club face. Laser pulses having irradiance greater than 4 GW/cm$^2$, with spot size greater than 4 mm$^2$ are used, including a pulse with on the order of 16 ns, with spot size greater than 9 mm$^2$. Residual compressive stress of more than 400 MPa penetrating with a depth of more than 0.2 mm are imparted, without increased hardening in or damage to the face of the club. Laser shock peening a pattern that covers an interior area leaves the perimeter unpeened, inducing a stress gradient between interior area and the perimeter of the club face. Multiple layers of arrays of laser shock impact zones are applied on the club. The technology is readily applied to assembled club heads.

41 Claims, 14 Drawing Sheets

PHOTOGRAPH

ENGINEERED RESIDUAL STRESS IN GOLF CLUBS

REFERENCE TO RELATED APPLICATION

The benefit of U.S. Provisional Application No. 60/804,775, filed 14 Jun. 2007 is claimed, and such application is incorporated by reference as if fully set forth herein.

BACKGROUND OF THE INVENTION

1. Field of the Invention

The present invention relates to an improved golf club, to an improved method for manufacturing a golf club, and more specifically to conditioning the impact face of a golf club with deep compressive stress using laser peening.

2. Description of Related Art

Shot peening has been suggested for club faces to provide better control and increased distance for golf shots. See, U.S. Pat. No. 5,487,543 by Funk. In particular, Funk describes shot peening the face of a club to impart residual compressive stress and harden the surface of the club, and claims that doing so improves the feel of the club by reducing vibration. Funk suggests that shot peening reduces the coefficient of friction of, and hardens, the club face. Funk applied relatively shallow compressive stress by shot peening on the front surface of the club face, with a peak amount of about 165 MPa at a depth of about 0.002 inches (0.043 mm). We note here that an MPa is a million Pascals. 165 MPa converts to about 24,000 pounds per square inch.

U.S. Pat. No. 6,994,635 by Poyner also teaches shot peening golf club heads "to increase hardness and residual compressive stress." Poyner, column 3 lines 24-25. However, the Poyner patent focuses on shot peening for the back surface of the ball striking surface to remove [alpha]-case, and to improve fatigue limits. In Poyner, it is suggested that the residual compressive stress in a back surface of a club face should be "as great as about sixty percent of the yield stress of a typical golf ball, which is about 62 MPa." Poyner, column 4, lines 64-67. Poyner then states, "Residual stresses exceeding 500 MPa may be produced by shot peening of titanium." Poyner, column 5, lines 5-6. This comment by Poyner appears to be a statement intended to show that shot peening is readily capable of inducing compressive stresses on the back surface of a club face in the range of "as great as about sixty percent of the yield stress of a typical golf ball . . . ", rather than a teaching to induce residual stress at that level.

Poyner also states that a portion of the "ball striking surface 24 may be peen treated as well, for example, to remove [alpha]-case." Poyner, column 5, lines 52-60. However, no discussion of the process used for the ball striking surface is provided.

Poyner also states, without discussion, that laser shock peening and abrasive waterjet peening could be applied. Poyner, column 6, lines 16-39.

Any treatment of golf clubs is subject to scrutiny by the United States Golf Association and other similar associations that regulate the manufacturing of golf clubs to insure fair play. See, Procedure for Measuring the Flexibility of a Golf Clubhead, USGA, Revision 2.0, Mar. 25, 2005. One key factor in golf club manufacturing is compliance with such regulations. Poyner found it relevant for example, to point out the golf clubs made as he suggested "approach the target coefficient of restitution of 0.829 (for a relative velocity of 160 ft/sec), which corresponds to the regulated value established by the United States Golf Association." Poyner, column 5, lines 35-39. The United States Golf Association USGA and other similar associations regulate the manufacturing of golf clubs to insure fair play. One key factor in golf club manufacturing is compliance with such regulations, including Rule 5a, Appendix II of the Rules of Golf, published by the USGA. Poyner found it relevant for example, to point out the golf clubs made as he suggested "approach the target coefficient of restitution of 0.829 (for a relative velocity of 160 ft/sec), which corresponds to the regulated value established by the United States Golf Association." Poyner, column 5, lines 35-39. To be recognized as acceptable for competition by the USGA and the Royal and Ancient Golf Club of St. Andrews Scotland, a club is limited in the amount of spring-like effect it can create. Spring-like effect is the ability of a clubface to act as a spring (or trampoline), adding extra oomph to a shot. It is tested by measuring the clubface's coefficient of restitution, or COR. This measurement is done using a standardized testing fixture and involves dropping a pendulum against the club face and measuring the time the pendulum is in contact with the face.

If the COR is too high, the club is deemed to act too much like a spring, and is ruled illegal. All clubs have a COR—even persimmon drivers had COR ratings—but all the fuss stemmed from the introduction of high COR metal drivers. Currently, in territories governed by the USGA, the COR limit is 0.830 for all competitions and all handicap rounds. In territories governed by the R&A, the COR limit will be 0.830 as of Jan. 1, 2008. In the meantime, a "condition of competition" is put into effect by the R&A for highly skilled players limiting COR to 0.830 for those players. Others (i.e., recreational players playing handicap rounds or participating in local events in which that condition of competition is not in effect) must adhere to a COR of 0.860 or less.

Another factor monitored by the USGA is known as Characteristic Time which measures flexibility of the club face. See, Procedure for Measuring the Flexibility of a Golf Clubhead, USGA, Revision 2.0, Mar. 25, 2005. Basically, the regulation requires that the Characteristic Time that the head of a pendulum remains in contact with the club face in a test in which the pendulum arm is dropped from a number of set heights, must be less than 239 microseconds.

Although shot peening has been investigated for the purposes of treating golf clubs to harden the surface, reduce the coefficient of friction, induce residual compressive stress and remove [alpha]-case for at least 12 years, no commercial application of the process is known to the present inventor suggesting that the prior art process has failed to provide significant improvement in golf club manufacturing.

It is desirable to improve golf clubs and golf club manufacturing processes, while remaining within the guidelines set for fair play by the golfing associations. Also, it is desirable to improve golf clubs to enhance the playing experience for golfers.

SUMMARY

A method of manufacturing a driver, or other types of golf club, is described that includes inducing residual compressive stress by high intensity laser shock peening to form an array of laser shock peened impact zones on the club face. The technology herein provides for laser shock peened with laser pulses having irradiance greater than 4 GW/cm$^2$, with spot size greater than 4 mm$^2$. In embodiments described the irradiance is greater than 6 GW/cm$^2$, with spot size greater than 9 mm$^2$. The technology imparts residual compressive stress of more than 400 MPa penetrating to a depth of more than 0.2 mm, forming substantially larger volumes of material in the club face including residual compressive stress, and at substantially greater magnitude of compressive stress in the manufactured golf club, than anticipated in the prior art. Unlike the shot peening anticipated in the prior art, laser shock peening, even at the intensities unheard of in the prior art and described herein, does not induce increased hardening in the face nor damage the face of the club.

While it has been discovered that high intensity laser shock peening covering substantially the entire club face yields surprising and improved results in performance of the golf club, a process is described herein including laser shock peening a pattern that covers an interior area leaving the perimeter unpeened, inducing a stress gradient between interior area and the perimeter of the club face results in even greater reduction of the characteristic time characteristic of the club.

Furthermore imparting multiple layers of arrays of laser shock impact zones on the club induces even greater depth and magnitude of compressive stress, and yields improved clubhead performance as described herein.

In addition, the technology described herein is readily applied to assembled club heads, without damaging or marring surfaces of the clubs, unlike the shot peening techniques described in the prior art.

The laser shock peening described herein can be applied to both the outside and inside surfaces of the club face to provide improved endurance for the clubhead, particularly in the region of stress risers on the inside surface of the club face.

Other aspects and advantages of the present invention can be seen in the drawings, the detailed description and the claims which follow.

DETAILED DESCRIPTION

A detailed description of embodiments of the present invention is provided with reference to the FIGS. 1-19.

A process for treating the impact face of golf clubs to achieve a response that provides increased release speed of the golf ball without increasing the Coefficient of Restitution (COR) of the club beyond acceptable limits, or while maintaining and actually reducing COR is described. This process imparts a deep and high intensity residual compressive stress into the club face resulting in an increase in the ball release speed and a decrease in the COR. The increase in release speed enables a struck ball to travel farther; maintaining the COR provides for a club that meets international standards for permitted competitive use. Furthermore, the characteristic time CT measurement is actually reduced for clubs treated in the manner described.

This improvement in club performance by employing laser peening can be achieved using a range of laser peening parameters and laser systems. One example embodiment was manufactured using laser peening at 6 GW/cm2, with 16 J/pulse output on target, over an area of 3.5 cm tall by 5.4 cm wide using a 3.85 mm square spot size and two layers of peening with pulse duration of approximately 18 ns. The surface of the club was cleaned with acetone followed by alcohol and then covered with 2 layers of Aluminum tape. The laser peening system is described below with reference to FIGS. 2-5.

Figure 9:
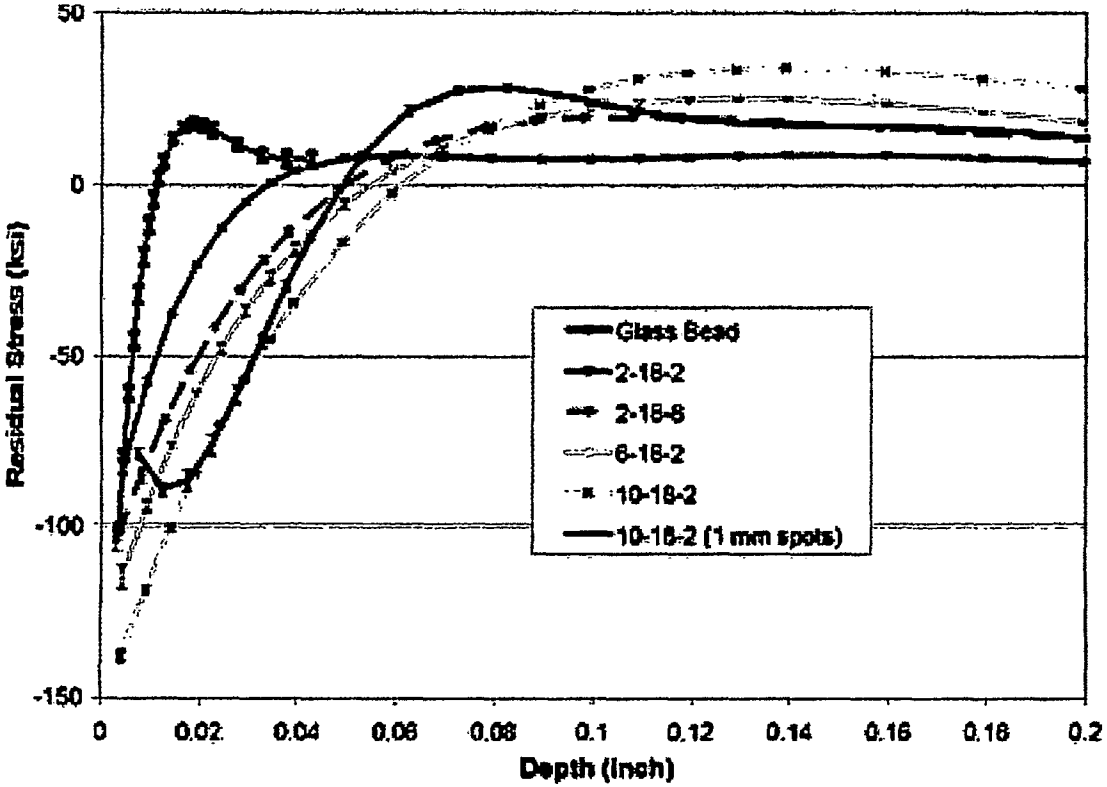
FIG. 9 is a graph of residual stress versus depth in a club face as described herein.

An alternate treatment may use lower energy pulses with 0.5 to 1.0 Joules with treatment spot sizes in the range of 0.5 to 1.0 mm (0.02 to 0.04 inches) on the side. Preferably spot sizes greater than 1.0 mm on a side are utilized to assist deeper penetration of the compressive stress. A pulse duration in the range of 7 ns to 100 ns is useful for peening the clubs, although pulse lengths can be varied as needed for a given laser system. It could be done with round spots rather than square. It could be done with a laser with lower pulse energy and smaller spots. It is anticipated that a lower limit will be in the range of 2 GW/cm2 and 4 to 6 layers of laser peening. The graph in FIG. 9 illustrates the trade off in treatment parameters and number of layers in thick Titanium samples, where the designation "2-18-2" indicates two layers of tape—18 nsec pulse width (fwhm)—2 layers of peening (offset one half spot width horizontally and vertically) for a pulse irradiance of 6 GW/cm$^2$ using a 3.85 mm on a side square spot, except as noted in the Figure. The residual stress to be approximately as shown by the green curve (identified as 6-18-2) in FIG. 9 for a club face comprising titanium alloy, such as a Ti 6/4 titanium alloy. The peak stress in the club is estimated to be more than 400 MPa near the surface, and peaking at as much as 875 MPa penetrating to a depth of approximately 1.25 mm (0.060 inches) in depth before becoming zero for the 2-18-2 parameter setting using pulse irradiance of 6 GW/cm$^2$ using a 3.85 mm on a side square spot.

Prior to laser peening, a club was tested using a mechanical testing machine. In this first test a club speed of 102 mph was used to strike the ball and a ball speed of 130 mph was measured giving a ball to club speed ratio of 1.4 to 1. After laser peening the ball speed increased to 150 mph, giving a ball to club speed ratio of 1.6 to 1. The test was repeated on a second club and the result at a club head speed of 93 mph gave essentially the same results, that is, an increase in the ball speed to club speed ratio from 1.4 to 1.6.

To be recognized as acceptable for competition by the United States Golf Association (USGA) and the Royal and Ancient Golf Club of St. Andrews Scotland a club is limited in the amount of spring-like effect it can create. Spring-like effect is the ability of a clubface to act as a spring (or trampoline), adding extra oomph to a shot. It is tested by measuring the clubface's coefficient of restitution, or COR. This measurement is done using a standardized testing fixture and involves dropping a pendulum against the club face and measuring the time the pendulum is in contact with the face. Before laser peening the clubs had a COR of 0.828 and after peening this was reduced to 0.822.

If the COR is too high, the club is deemed to act too much like a spring, and is ruled illegal. All clubs have a COR—even persimmon drivers had COR ratings—but all the fuss stemmed from the introduction of high COR metal drivers. Currently, in territories governed by the USGA, the COR limit is 0.830 for all competitions and all handicap rounds. In territories governed by the R&A, the COR limit will be 0.830 as of Jan. 1, 2008. In the meantime, a "condition of competition" is put into effect by the R&A for highly skilled players limiting COR to 0.830 for those players. Others (i.e., recreational players playing handicap rounds or participating in local events in which that condition of competition is not in effect) must adhere to a COR of 0.860 or less.

Putting compressive stress on the front face and the ball imparts an additional compressive load there. Because the front face has started out in a convex shape, the peening here adds compressive stress to both the front and the back face with strong tensile stress going into the center region of the face. The loading from the ball would create compressive stress on front and tensile load on the rear side which could change the dynamics (effective spring like behavior, that is deflection vs. time, of the surface when loaded by impact with the ball. We measure the spring-like behavior of the face using the R&A approved pendulum test and for the pendulum we are actually less spring-like.

Figure 1:
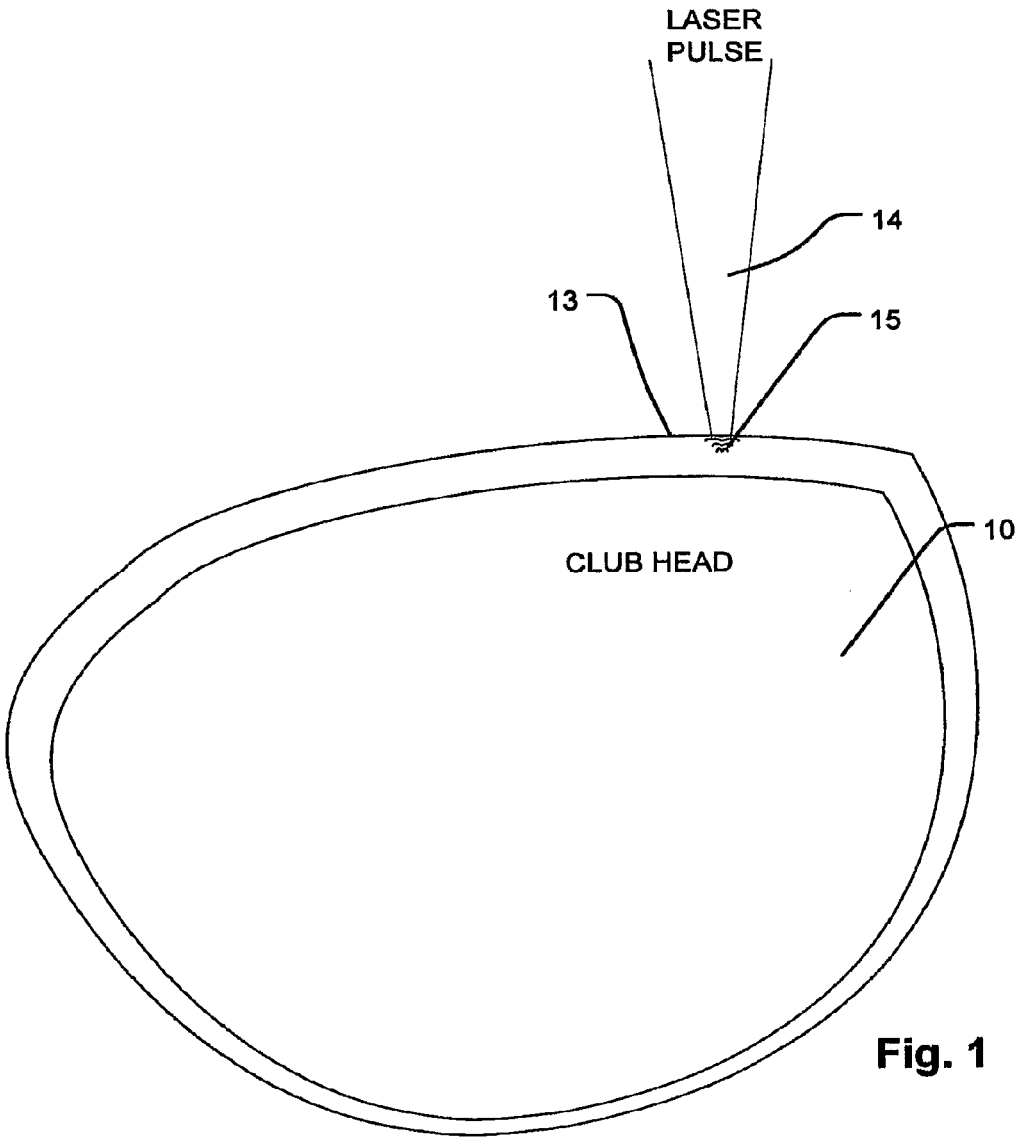
FIG. 1 illustrates laser peening an outside surface of the club face of an assembled, metal club head.

As illustrated in FIG. 1, the basic configuration of an assembled club head 10 (in cut-out view, where the thickness of the metal is exaggerated for the purposes of the illustration) with a laser pulse 14 impacting an impact area 13 on the outside surface of the ball striking, club face of the club head 10 is illustrated in FIG. 1. The laser pulses are applied in a pattern to induce deep residual compressive stress in the impact area 13. For example, pulses 14 having energies greater than 1 joule per pulse with the pulse width of about 30 nanoseconds or less, and an area (spot size) on the surface to be preened on the order of 1 to 25 mm$^2$. Peak irradiance on the order of GigaWatts per cm$^2$ (GW/cm$^2$) are applied for laser peening, including for example higher than 0.5 GW/cm$^2$. Peak irradiance of 10 GW/cm$^2$, or higher depending on the tamping material used, can be applied. The laser pulses 14 impart residual compressive stress 15 in the face which extends relatively deeply into the face, such as more than 0.2 mm, including as much as 0.4 to 0.8 mm. In addition, the pulse causes a deformation of the face in the shape of the pulse, on the order of a few microns deep. In addition, the pulses induce residual compressive stress without significantly increasing the cold working of the surface, and therefore without significantly increasing the hardness of the surface.

Figure 2:
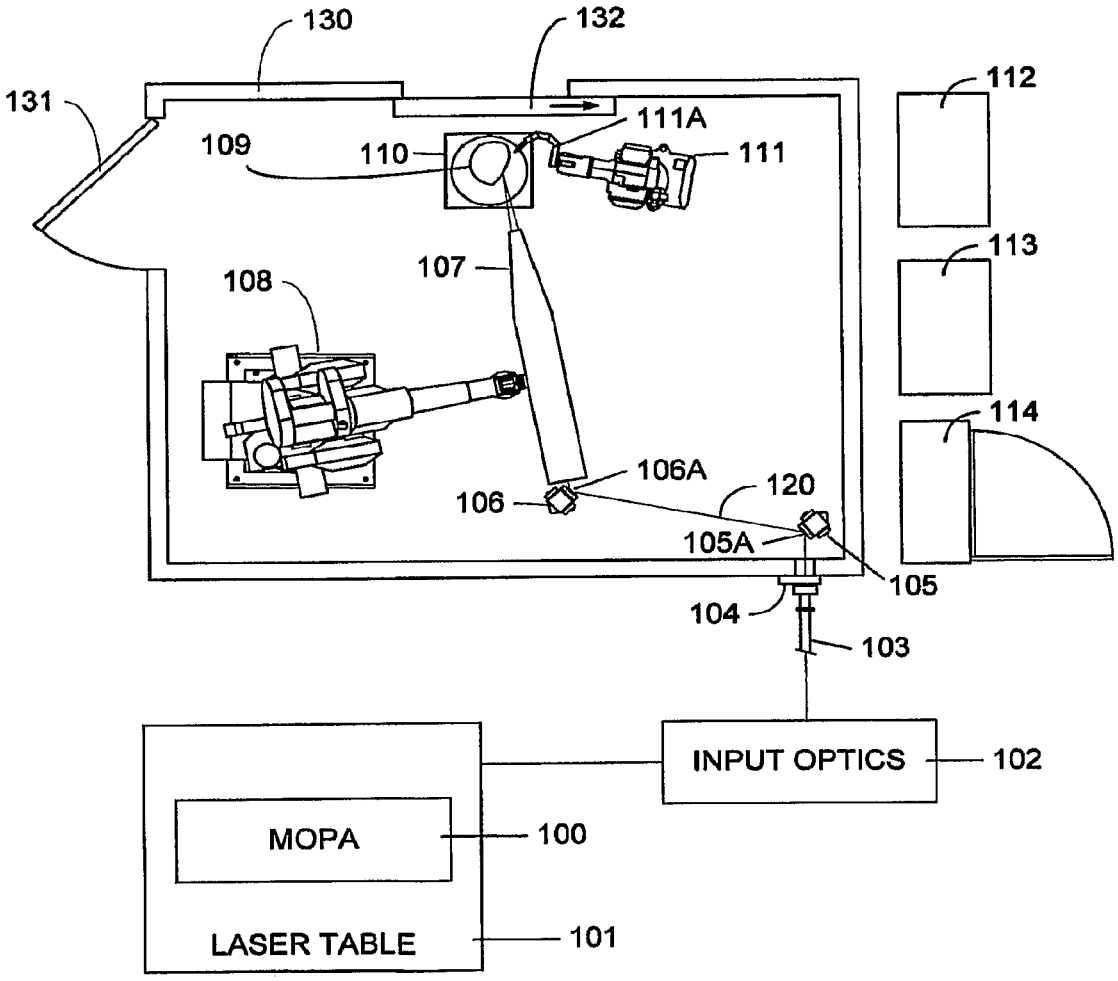
FIG. 2 is a diagram of an energy delivery system configured for laser peening an assembled club head of a golf club.

FIG. 2 shows a schematic of a suitable laser peening system for peening the assembled club head 109. This is not meant to be a scale design of an actual system but illustrates basic components and their layout. The system of FIG. 2 includes a laser 100 in a master oscillator/power amplifier configuration, such as described in U.S. patent application Publication entitled STIMULATED BRILLOUIN SCATTERING MIRROR SYSTEM, HIGH POWER LASER AND LASER PEENING METHOD AND SYSTEM USING SAME; Publication No. US-2005-0094256-A1, filed 28 Jan. 2004, by Dane et al., which is incorporated by reference as if fully set forth herein, and attached hereto. Other laser energy sources can be used as well. For laser peening, the output of the laser system consists of pulses typically greater than 1 joule per pulse with the pulse width less than 30 nanoseconds, for example pulses having more than 20 joules per pulse and a pulse width between 10 and 20 nanoseconds can be used, and which have a wavelength substantially absorbed by the ablative layer on the surface to be peened. In this system, the laser 100 is mounted on a stable laser table 101. Output from the source of laser energy is applied to input optics 102 which condition the beam for delivery through a relay telescope 103 to a transmitting mirror 105A mounted on transmitting mirror gimbal 105. The transmitting mirror 105A reflects the beam to a receiving mirror 106A mounted on receiving mirror gimbal 106. The receiving mirror 106A on receiving mirror gimbal 106 is part of a robot mounted optical assembly 107, which is in turn positioned by robot 108. The robot mounted optical assembly 107 includes output optics for directing the beam to a target location on a surface of a workpiece 109. In this embodiment, the workpiece 109 is mounted on a rotatable parts holder 110. A water delivery robot 111 is mounted near the parts holder 110, and includes a vessel 111A for delivery of tamping fluid in the laser peening application. The robot 111 in embodiments of the technology also controls placement of a coordinate measuring metrology touch probe (such as the Renishaw style) used during laser peening operations. A controller 112 for the robot 111, a controller 113 for the robot 108, and a controller 114 for coordinating operation of the robots and adjustable components in the beam delivery system and in the laser 100, and other controllable components, are provided with the system.

The basic optical path from the input optics 102 to the target workpiece includes just two turns in this embodiment, which are controlled using high-speed, high-resolution gimbals. The optical path includes a segment 120, between the transmitting mirror 105A and the receiving mirror 106A, which is essentially straight and has a variable length through air, and a variable direction defined by the angle setting of the transmitting mirror gimbal. The variable length is controlled by the robot 108 based on the positioning of the optical assembly 107 when moving the beam line to a target location on the surface of the workpiece 109. Likewise, the variable direction is set using the gimbals 105, 106 according to the positioning of the optical assembly 107. In the embodiment illustrated, the segment 120 extends through free air, that is without an enclosure such as a tube. In other embodiments, a telescoping tube or other enclosure could be provided so long as it is sufficiently adjustable.

The water robot 111 is used to deliver the transparent tamping layer to the surface of the treated part. An alternative system integrates a water delivery vessel on to the robot 108 along with the robot mounted optical assembly 107.

A process chamber 130 is illustrated, including an access door 131 for technicians, a parts access door 132 which allows access to the parts holder 110, and a shutter 104 for admitting the laser radiation. The process chamber 130 allows provision of a controlled environment for the operation of the robot 108, with a parts holder 110 used to provide only limited positioning functions for the laser peening operation. The process chamber 130 is mounted on a platform, such as a foundation or movable plank, and the transmitting mirror gimbal 105, robot 108 with the robot mounted optical assembly 107, the robot 111 and the rotatable parts holder 110 are all mounted thereon in a fixed spatial relationship. The laser 100 and input optics 102 are mounted on separate stages, closely coupled with the process chamber 130.

Figure 3:
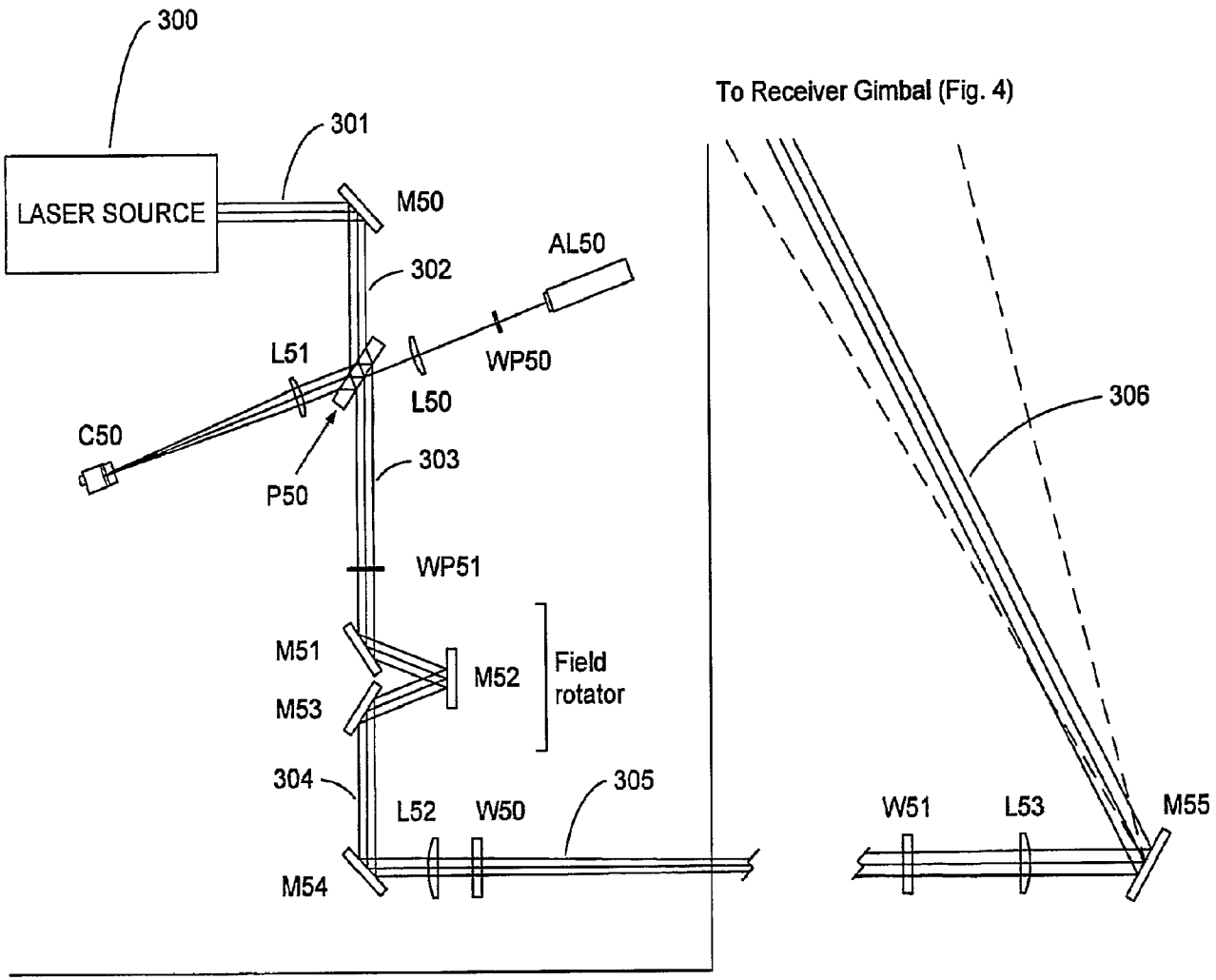
FIG. 3 is a diagram of input optics and a transmitting mirror for energy delivery systems like that of FIG. 2.

FIG. 3 illustrates a layout for input optics up to the transmitting mirror, labeled M55 in FIG. 3. Laser source 300 provides an output beam on line 301 defining a first segment of the optical path. Mirror M50 reflects the beam on line 302 defining a second segment of the optical path to active alignment optics which comprise alignment laser AL50, half wave plate WP50, lens L50, polarizer P50, lens L51 and camera C50. The beam which propagates through the polarizer P50 proceeds on a third segment of the optical path along line 303 through wave plate WP51 to field rotator optics which comprise mirror M51, mirror M52 and mirror M53. From mirror M53, the beam as rotated propagates on a fourth segment of the optical path on line 304 to mirror M54. Mirror M54 turns the beam through a beam transport telescope (also called relay telescope) which comprises lens L52 and lens L53, on a fifth segment of the optical path along line 305 to the gimbal-mounted transmitting mirror M55. Windows W50 and W51 define the input and output of a vacuum chamber (not shown) for the telescope, in which the beam is brought through a focus. The transmitting mirror M55 turns the beam on a variable angle along a sixth segment of the optical path on line 306, which is directed at the receiving mirror on the robot mounted optical assembly as described above, through a variable length of air.

The alignment laser AL50 in one embodiment comprises a continuous-wave (CW, i.e. non-pulsed) laser to verify correct alignment and, if necessary, to enable feedback adjustments to the alignment in between laser shots. In one embodiment, the alignment laser AL50 comprises a diode-pumped Nd:YLF laser which produces relatively low output power (<500 mW). The alignment laser AL50 has the same wavelength as the peening laser 300, or is otherwise configured so that the reflecting and focusing properties of the alignment beam through all of the optics can be reliably used for alignment of the high power beam.

The divergent output from alignment laser AL50 (<500 mW) is collimated by lens L50 and combined with the high power beam path at polarizing beam splitter P50. Using half waveplate WP50, the polarization of the alignment laser is set to S-polarization so that it reflects at the polarizer on the beam line 303. A small portion of the high power beam transmitted in P-polarization is reflected at the polarizer P50, and a small portion of the alignment beam is transmitted through polarizer P50 to the camera C50. Diagnostic camera C50 detects the positions of the alignment and high power beams, and provides feedback for achieving precise co-alignment. The camera is placed at the focus of lens L51. When the far field (focal point) of the small leakage of the high power beam reflected from the surface of polarizer P50 precisely overlaps the focal point of a portion of the alignment beam that transmits through the polarizer P50, then co-alignment is confirmed. Waveplate WP50 can be rotated to allow the fraction of alignment beam transmission through the polarizer P50 to be adjusted.

In embodiments of the system in which the output of the high power laser is not round, rotation of the cross-section of the beam caused by the transmitting and receiving mirrors is compensated in the field rotator optics. For example, in a laser peening system, a square beam cross-section, or other rectangular shape, is preferred. Depending on the relative angle between the plane containing the incident and reflected beams on the gimbal-mounted transmitting mirror M55 and the plane containing the incident and reflected beams on the gimbal-mounted receiving mirror M56 (see FIG. 4), the square beam will be rotated with respect to the coordinates of the robot mounted optical assembly. The field rotator optics pre-rotate the beam cross-section so that the desired spot orientation is delivered to the target surface. The field rotator optics consist of three mirrors M51-53 which are rigidly mounted on a common structure which can rotate around the input beam axis using a remotely controlled rotational stage. Since there is an odd number of reflections (3), rotating this three mirror assembly will cause the square beam to rotate at 2× the rate, i.e. a 45 degree mirror assembly rotation will cause a full 90 degree beam rotation. In the case of a square beam, a ±22.5 degree rotation of the field rotator will provide all required beam orientations. Other optical arrangements can be utilized for providing field rotation.

It may be desirable, e.g. for off-axis peening, that the polarization state of the beam not be orthogonally aligned to the square beam shape. Waveplate WP51, placed in the high power beam path, will allow the polarization to be rotated to an arbitrary linear state. Like the field rotator, it will be mounted in a remotely-controlled rotational stage and the polarization will rotate at twice (2×) the rate of rotation of the stage.

The transport telescope, formed from lenses L52 and L53, serves to enlarge the square beam and to relay an optical image across the free-propagation path to the processing head comprising the robot mounted optical assembly. Through this telescope, the beam is magnified in one embodiment by about 1.4× from a nominal dimension of 23 mm square to 32.5 mm. This has three functions. The first is that the beam area is increased by 2× on the transmitter and receiver mirrors, lessening the risk of optical damage. The second function is that the relay distance of the telescope is increased by the magnification squared (i.e. 2×) making it possible to provide a well defined beam image at the distant treatment plane. Finally, magnifying the beam increases the Raleigh range (defined as twice the confocal parameter) by 2× with a 1.4 times magnification, improving the free-space propagation characteristics of the beam. This third function is important since the optical relay telescope and the beam delivery telescope in the processing head have been optimized for a single propagation distance. However, as the processing head is maneuvered within a ±45 degree processing solid angle, the actual propagation distance between the gimbals can vary by up to ±1 m.

This variation can be even larger in the case of the arrangement for in situ laser peening of large parts as shown in FIG. 2.

The transmitter and receiver gimbals are of similar design and specifications in an embodiment of the system. The motor for a representative system in each axis has a resolution of 25 μrad (5.2 arcsec), a repeatability of 50 μrad (10.3 arcsec), and an absolute accuracy of 100 μrad (20.6 arcsec). These specifications are for the actual reflected beam; the values for the mirror angles are 2× smaller. The transmitter and receiver mirrors are 4 inches in diameter in a representative embodiment, and have a high damage threshold coating that efficiently reflects the beam over an angle of incidence range of 15-55 degrees.

Figure 4:
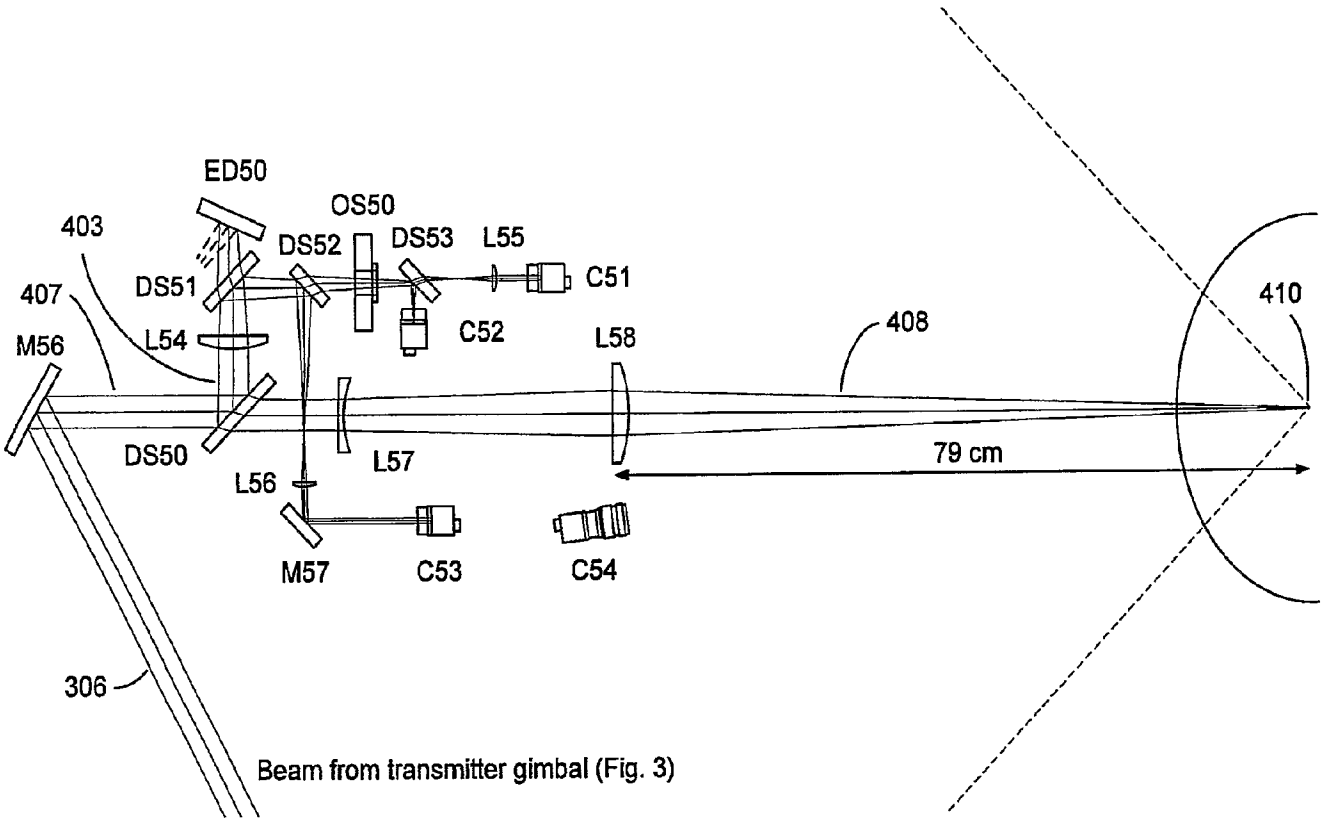
FIG. 4 is a diagram of robot mounted optical assembly, including a receiving mirror and output optics for energy delivery systems like that of FIG. 2.

FIG. 4 illustrates the receiving mirror M56, and other optics in the robot mounted optical assembly on the processing head in an embodiment of the system including input optics of FIG. 3. The receiving mirror M56 accepts the beam on beam line 306 from the transmitting mirror M55 (FIG. 3). The receiving mirror M56 is adjusted to turn the beam on a seventh segment of the optical path on line 407 toward diagnostic beam splitter DS50. The beam propagates through the diagnostic beam splitter DS50 to an output telescope comprising lenses L57 and L58. The combination of the beam transport telescope and input optics, and the output telescope on the processing head establish a target image plane 410 for a 3 mm spot at a location 79 cm from the final lens L58 in one embodiment.

The relay imaging system illustrated in FIGS. 3 and 4 places a precise, demagnified image of the near field output beam from the laser near the surface of the part. Using a laser source like that shown in FIG. 5, which produces a highly uniform, flat-topped irradiance profile in the near field output of the laser, a highly uniform, flat-topped irradiance profile, free from significant optical diffraction structure otherwise caused by propagation away from the source, is projected into a target image plane that lies within a determinate range of the target surface of the work piece. The irradiance profile on the target surface of the work piece within a determinate range of this target image plane maintains substantially the same quality as the near field image from the output of the laser. The range allowed around the target image plane for placement of the work piece depends on the parameters of the operation being performed, and can be for example within plus or minus one meter of the target image plane in a particular embodiment. In other embodiments, lesser or greater determinate ranges for placement of the target surface on the work piece relative to the target image plane are suitable, depending on the characteristics of the laser energy, the requirements of the function being performed by the laser energy and other factors.

Beam diagnostics on the processing head provide for sensing shot-to-shot energy measurements, alignment diagnostics, and output beam profile diagnostics. Diagnostic beam splitter DS50 directs a small fraction (about 0.8% for example) of the incoming beam to the diagnostic components on line 403 through lens L54, and diagnostic beam splitter DS51. A calibrated pyroelectric energy meter ED50 placed in the beam which propagates through the diagnostic beam splitter DS51 will provide shot-to-shot energy measurements at the processing head. The diagnostic beam splitter DS51 directs a portion of this beam to alignment diagnostics including diagnostic beam splitter DS52, optical shutter OS50, diagnostic beam splitter DS53, lens L55, camera C51, camera C52, lens L56, mirror M57 and camera C53. The telescope consisting of lenses L54 and L56 forms an image of the high power square beam at the output aperture of the laser on camera C53. This also corresponds to the spatial profile, scaled in size, at the treatment plane on the surface of the part. Lenses L54 and L55 place an image of the beam at the plane of the receiver gimbal mirror M56 onto camera C51. Camera C52 is placed at the focus (far field) of lens L54 so that the position of the alignment beam on this camera indicates the pointing angle from the receiver gimbal. The optical shutter OS50 is closed during high energy peening in order to protect the alignment cameras from the high power beam since C51 and C52 are set up to be used with the low power CW alignment beam.

For the purpose of context, in a system utilized for laser peening club heads mounted on a fixed stage, or on a rotating stage; as described above; the distance from the receiver gimbal and the target plane in a typical system may be from about 0.5 to about 1.5 meters. The distance however can be longer or as shorter, depending on the particular use of the beam delivery system and practical limitations on sized of components.

The automation of the active beam delivery system including the transmitter and receiver gimbals can be accomplished with a software controlled robot system including a program acting as a "controller in charge," executing the laser peening process by manipulating the beam delivery tool. A previously defined process map for a given part is traversed by the controller, which will fire the laser, as needed. A higher level system can be configured to transfer process control from the robot system to a central controller. This controller would direct the laser (via fire triggers), beam delivery gimbals, as well as the two process robots. Other control system configurations can be applied as suits the particular embodiment, including for example a remote computer for centralized actuation of in situ processing.

The process variables for each laser spot on a part consist of a (x, y, z) target location, an incidence angles (θ, ϕ) on the target location, the square beam rotation parameter, and the distance of the processing head from the treatment surface (determining spot size). As the robot controller (or a higher level central controller) prepares to move the processing head to the next processing spot, it broadcasts the parameters to the gimbal controller logic so that appropriate adjustments to the transmitter and receiver gimbal angles, as well as the field and polarization rotations, can be made in coordination with robot motion. Based on the calibrated position of the robot, the parameters should include the computed (x, y, z) position of the center of the receiver gimbal, the (θ, ϕ) angle to the part, and the square beam rotation. When the gimbal controller logic has finished the move and the gimbals have settled, it will notify the robot controller which can then fire the laser and move to the next processing spot.

In order to direct the high power beam from the transmitter gimbal mirror to the center of the receiving gimbal mirror and then to orient the receiving gimbal mirror to deliver the beam accurately down the optical axis of the processing head, the gimbal controls are calibrated to the coordinate system used by the robot controller. Mapping of the coordinate system can be done, for example, by causing the robot controller to step through a known set of calibration positions, based on its own coordinate system. At each position, the beam can first manually, then under feedback control, be optimally directed to match each position. From the position data broadcast by the robot controller for each point and the gimbal angles required to match these positions, a consistent coordinate system can be constructed for the gimbal controller logic.

As described above, there are four calibration cameras mounted to the processing head. Each of these has a separate alignment role. There are two representative modes of operation using the alignment cameras. In the first, the cameras will be used only to periodically confirm correct beam alignment to the processing head optical axis such as during a calibration procedure or before the processing of each part or group of spots on a part. The second mode of operation will involve closed-loop optimization of the pointing angles in between each laser shot. The process applied in a given application therefore includes a single calibration step using the low power laser, continuous calibration between each laser shot, or some intermediate regime.

In one embodiment, the outputs of each of the four diagnostic cameras are fed into a 4-channel frame-grabber. Onboard image machine-vision processing will offload computational demands from the control computer, allowing maximum throughput. Each camera is capable of triggered operation in an embodiment of the system, so that image acquisition can begin immediately, on demand, without the need to wait for the next CCD refresh cycle. A description of examples of the function of each of the four cameras is provided in the following sections.

The gimbal position camera is denoted as C51 in FIG. 4. The optics feeding C51 are set up to provide an image of the alignment beam at the optical plane of the receiver gimbal mirror. In this way, the calibrated position of the beam image on the camera provides information about the centering of the beam on the receiver mirror M56 and is not effected by the tilt angle on receiver mirror M56 (within the field of view of the camera). Given a calibrated coordinate system for the gimbals, the position of the beam on receiver mirror M56 then directly corresponds only to the delivery angle of the transmitting gimbal mirror M55 and can be used to correct the delivery angle from the transmitter gimbal mirror M55.

The gimbal angle camera is denoted as C52 in FIG. 4. C52 is placed precisely at the focal point of the lens L54. In this way, the position of the beam image on this camera relates to the beam delivery angle from the receiver gimbal mirror M56 and is not affected by the position of the beam on the receiver gimbal mirror M56. The position of the image on the camera can be used to correct the delivery angle from the receiver gimbal mirror M56.

The near-field camera is denoted as C53 in FIG. 4. The optics feeding C53 are set up to provide an image of the high power square beam at, or in the near field of, the output aperture of the laser system. This image also provides the spatial profile of the beam at the treatment surface. By placing the camera on the beam delivery processing head, any problems that could arise from optical damage in the beam delivery train or from misalignment or beam clipping can be detected. The size of the beam, its uniformity, and its rotational orientation for each laser shot can be monitored.

The process camera is depicted in FIG. 4 as C54. It is mounted on the output of the processing head and will be fitted with a standard video imaging lens which will have a fixed focus at the treatment plane. It can show a detailed view of laser peening progress. Camera C54 has many more alternative or additional applications. In one embodiment, the camera will be able to view both ambient visible lighting as well as the low-power infrared alignment beam, and can be used to actively align the robot coordinate system to the optical axis of the processing head. The process camera C54 is used in an embodiment to apply machine-vision analysis to locate and calibrate the position of the part to be treated, potentially eliminating the need for coordinate measurement with a touch probe (Renishaw style). Using calibration targets of known dimensions, analysis of recorded image dimensions will also provide the calibration of the distance between the processing head and the treatment surface.

Figure 5:
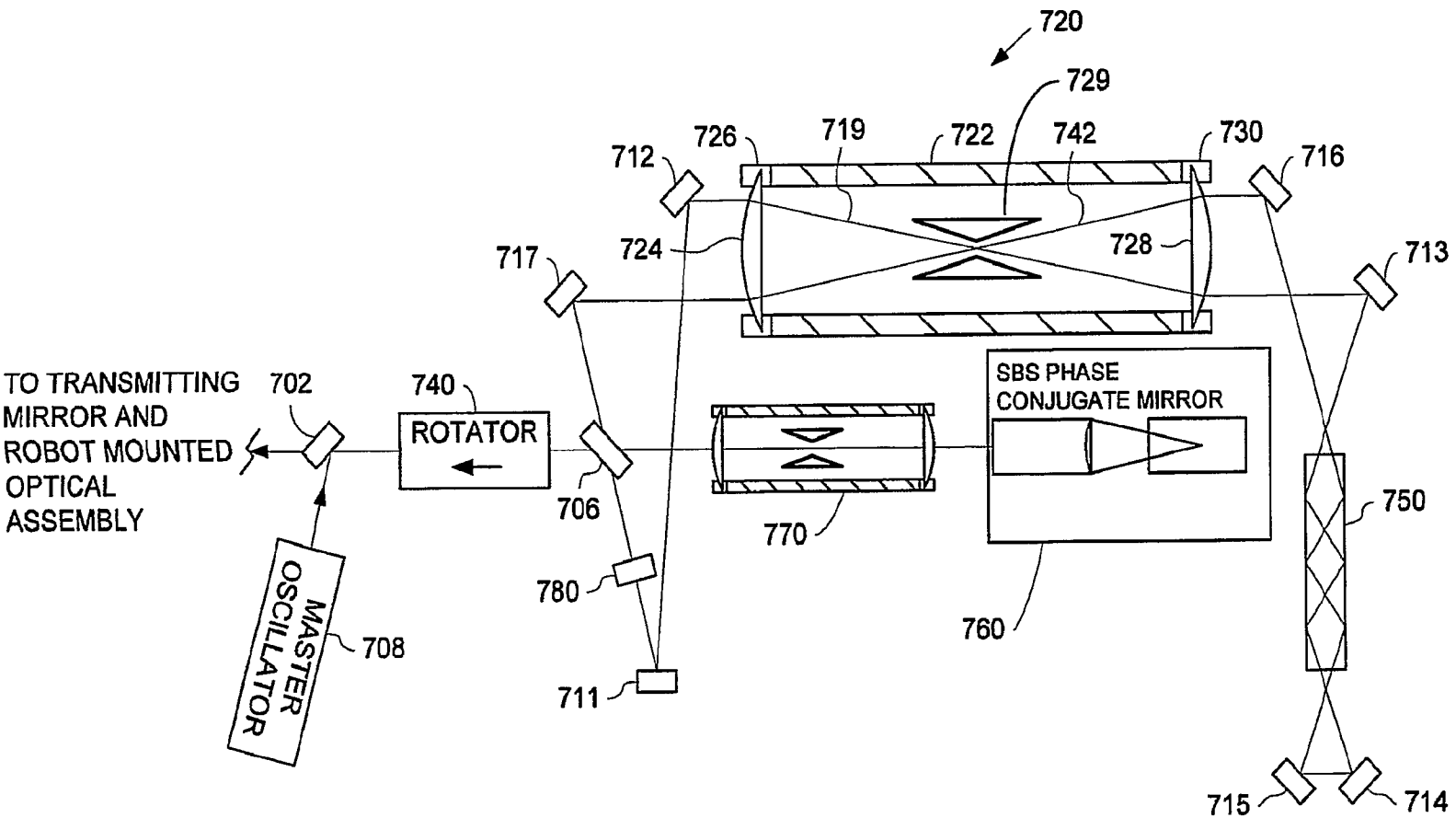
FIG. 5 is a diagram of a source of laser energy configured for use in combination with energy delivery systems like that of FIG. 2.
Figure 6:
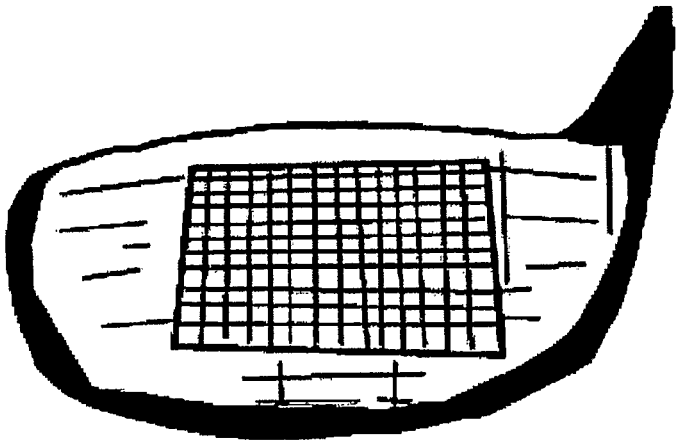
FIG. 6 is a drawing of a first array of peened spots on an ablative tape layer on an assembled club head.

The basic architecture of a master oscillator/power amplifier configuration with a regenerative laser amplifier including an SBS phase conjugator mirror system and relay telescope with a baffle is shown in FIG. 5, that is suitable for use in systems as described herein. The embodiment of FIG. 5 is an improved version of a similar amplifier described in U.S. Pat. No. 5,239,408, which is incorporated by reference as if fully set forth herein. The amplifier system of FIG. 5 includes a rotator 740, such as a Pockels cell or Faraday rotator, a first intra-cavity relay telescope 720, a slab-shaped gain medium 750, a second intra-cavity relay telescope 770 and an SBS phase conjugator/mirror system 760. The slab 750 is enclosed in a pump cavity (not shown). Two polarizers 702 and 706 are also included for capturing an input pulse, and extracting an output pulse, respectively. Seven flat, highly reflecting mirrors 711, 712, 713, 714, 715, 716, and 717, define an optical path through the slab 750, and telescope 720, polarizer 706 and telescope 770 connect the ring to SBS phase conjugator 760. An additional relay telescope 780 relays images of the near field output (a location near the output at polarizer 706) of the ring amplifier to target delivery optics not shown.

In operation, a master oscillator 708 supplies an input pulse which has S-polarization. The pulse reflects off polarizer 702, proceeds through an isolation rotator 740, remaining unchanged in polarization, and is further reflected off polarizer 706 into a ring shaped optical path defined by mirrors 711-717, proceeding for this ring transit in a counter-clockwise direction off of the polarizer 706.

In the ring, the beam enters the 90 degree rotator 780 which rotates the beam by 90 degrees to the P-polarization. The pulse proceeds through mirrors 711 and 712 along optical path 719 through relay telescope 720.

The telescope 720 includes a vacuum chamber 722 having a first lens 724 mounted by a vacuum tight seal 726, and a second lens 728 mounted by vacuum tight seal 730. A baffle 729 at the telescope focal point inside the vacuum chamber 722 blocks off angle beams and ghost reflections.

From telescope 720, the beam proceeds through mirror 713 into and through the slab 750 where it is reflected by mirrors 714 and 715 back through the slab 750. Near unity fill of the pumped volume is accomplished by a first zig-zag pass and a second zig-zag pass which are essentially mirror images about the direction of propagation. In this way, the second zig-zag pass will tend to extract gain from regions that may have been missed in the first pass.

From slab 750, the beam is reflected off mirror 716 along path 742 through telescope 720, off mirror 717 where it is reflected back into polarizer 706. Since the beam has been rotated by the 90 degree rotator 780 from the S-polarization to the P-polarization, the P-polarized beam is transmitted by polarizer 706 to 90 degree rotator 780 to proceed through the ring counter-clockwise a second time. However, during this second pass through the ring, 90 degree rotator 780 rotates the polarization by 90 degrees back to the S-polarization. Therefore, when the beam reaches the polarizer 706 at the end of a second pass through the ring, it will be reflected into SBS phase conjugator 760, through the second intra-cavity relay telescope 770.

The beam proceeding back out of the SBS phase conjugator, still having the S-polarization, but reversed phase error, will be reflected by polarizer 706 in a clockwise direction to mirror 717 where it will proceed along path 742 through telescope 720 to mirror 716. From mirror 716, the beam will proceed through slab 750 a first time and be reflected back through the slab 750 a second time by mirrors 714 and 715. Proceeding out of slab 750, the beam will be reflected off mirror 713 and proceed back through telescope 720 and mirrors 712 and 711 to 90 degree rotator 780. The 90 degree rotator 780 will rotate the polarization by 90 degrees back to the P-polarization and transmit the beam to polarizer 706, thus completing a third pass through the ring, but this time in the reverse direction from the first two passes.

Since the beam has a P-polarization, the beam will pass through polarizer 706 and proceed clockwise through the ring for a fourth pass through the ring, or a second pass in the reverse direction. At the end of this fourth pass through the ring, the 90 degree rotator will rotate the polarization back to the S-polarization causing the beam to reflect off of polarizer 706 out of the ring and into isolation rotator 740. By this point, the net accumulated phase error is essentially zero, providing a wavefront corrected output pulse. The isolation rotator 740 will rotate the polarization of the beam to the P-polarization enabling the beam to pass through polarizer 702 as a high energy output pulse.

Thus, the beams passing through the amplifier illustrated in FIG. 5 exhibit reduced diffraction, minimizing the likelihood of high peak perturbations in a beam, by utilizing two paths around the ring before entering the phase conjugator, and two equal and opposite paths around a ring after exiting the phase conjugator. The ring, further, utilizes a passive polarization rotator instead of a Pockels cell. Additionally, all optical components within the amplifier are placed near the image planes by the use of relay telescopes (two paths through first intra-cavity telescope 720 and of the second intra-cavity telescope 770). The amplifier also exhibits higher gain-to-loss ratio, with two slab passes providing gain in each ring transit. The SBS phase conjugator acts as a mirror system and offsets phase aberrations in the beam. In embodiments of the invention, the SBS phase conjugator/mirror system 760 includes components used for pulse width control, used as an alignment fiducial for the optical path in the ring, and which limit self-focusing and other aberrations induced by SBS media.

The single-frequency master oscillator 708 in FIG. 5 in one preferred embodiment, comprises a relaxation pulse-seeded oscillator, which provides consistent single-frequency with good amplitude and temporal stability, with representative pulse profiles having a pulse height of greater than 1.2 megawatts and a pulse width of about 24 nanoseconds full width half maximum. Other master oscillator embodiments can be used as mentioned above. The relaxation pulse-seeded oscillator in one embodiment includes a laser resonator having an output coupler and a number of other reflectors defining an optical ring, preferably having an odd total number of reflectors including the output coupler. A Q-switch and a gain medium are included in the resonator. A detector is coupled with the resonator to detect oscillation energy in the resonator. A controller is coupled to a source of energy for the gain medium, to the Q-switch, and to the detector. A component in the resonator induces loss while building up gain in the gain medium with the source of pump energy, until a gain-to-loss ratio is achieved that is sufficient to produce a relaxation oscillation pulse. Upon detection of an onset of the relaxation pulse, the controller decreases the loss using the Q-switching so that an output pulse having a single frequency is generated. A set of etalons in the resonator restricts oscillation to a single longitudinal cavity mode during the onset of the relaxation oscillation pulse. Also, a transverse mode limiting aperture is placed in the laser resonator.

An example process for peening a club head using a system like that described above is described. First we receive the club and wipe the surface with acetone to clean off any dirt, adhesive or anything left from packaging. Then we wipe it with alcohol to remove any residue of acetone. Next we apply a first layer of tape and a second layer of tape as shown in the FIG. 6—this provides a protective layer to keep from tarnishing the surface in case the first layer is breached by the peening pulse. Now we set up the laser for peening. We adjust the energy until we measure 16 J per pulse at the laser/club interaction point. The laser energy is absolutely calibrated with a calorimeter on a regular schedule and this is referred to a relative calorimeter that constantly monitors the laser energy. We set the pulse duration at 18 ns by looking at the output pulse shape on a fast oscilloscope. 18 ns is set at the full width of the pulse at half of maximum amplitude—the pulse looks something like a Gaussian (bell) shaped curve. In order to have 6 GW/cm$^2$ irradiance at the target we set the spot size on a side at that target to be x=Sqrt((16 J/18 ns)/6 GW/cm$^2$)=0.385 cm. The way we set the spot size is to take advantage that the laser is coming to a focus with an F number of about 1.9. Thus the beam is getting smaller as one gets further away from the final lens. We just move closer to or further away from this lens until we find the spot where the beam is of the desired size. We check the spot size using paper sensitized to show a "burn" when the laser light hits it. We physically measure the size of the burn. With the first two parameters set and spot size correct, we peen a layer on the golf club. We turn on the water for the tamping layer and begin putting down one pulse after another moving the beam from spot position to spot position. Referring to photo in FIG. 6, you can see a peening pattern of 10 rows and 14 columns with the ablative tape layer still in place after the first layer of peening—this is 6-18-1. We will remove the tape layer, put another one on as shown in FIG. 7, and the peen again, moving the pattern of spots over by d=0.385/2 cm and down by the same amount. When this second layer is peened we now have peened the golf club at 6-18-2. Clubs having the 6-18-1 process applied show reduction in characteristic time. However, it is discovered that 6-18-2 shows even greater reduction.

The 6 GW/cm$^2$ represents the power density of the laser energy on the target. The larger this value, the greater the energy deposited and thus the higher the pressure in the shock wave and the more intense and the deeper the peening. The pulse duration, 18 ns in our embodiment, represents how long the laser energy is being delivered. The shock pressure lasts about twice as long as the laser pulse duration. When the pulse arrives at the target, a shock wave is generated within 1 ns and begins to travel through the ablative layer and into the golf club face compressing the material as it propagates. It propagates at the speed of sound into the material, at a speed of about 5000 m/s. When the pulse ends after about 18 ns, the plasma will start to cool and the pressure drop in about 36 ns. This drop in pressure, also propagates into the metal but it is now propagating in material that has been densified by the shock wave and will travel faster. It can eventually catch up to the initial shock wave and results in the shock front being dissipated. If the pulse duration is too short, the dissipation occurs at a shallower depth and the resulting depth of compressive stress is not sufficient. If the pulse duration is set longer, more energy is required out of the laser to keep the fluence at the same 6 GW/cm$^2$ level. A higher energy laser is more difficult and more expensive to build. Subsequent layers increase the depth of the imparted residual compressive stress, using the same laser system.

Another important factor is the spot size. The spot size determines the physical extent of the pressure pulse generated for doing the peening. But as the pulse propagates into the metal, the fact that the spot is of finite size "propagates" in from the edges, rarefying the intensity from the edges toward the middle of the shock spot. So the spot is effectively getting smaller at the same rate it is propagating into the material. In laser peening we typically want the shock to penetrate a millimeter or more so we are best to make the spot size reasonably greater than 1 mm on a side. This if one peens with a laser energy of 1 J rather than 16 J, the spot size has to decrease by a factor of square root of 16, that is by 4 times. Square spot sizes from about 1.0 to about 4.0 mm on a side are representative of sizes expected to produce results, with greater spot sizes preferred.

By peening only one side we minimize stretch and add some curvature and probably importantly, leave the front surface with a much higher level of compressive stress than the back face. We end up with a significant imbalance in stress with the front face being more highly compressive.

Laser peening imparts compressive stress relatively deeply, greater that 0.2 mm, and more preferably greater that 0.4 mm, including about 0.8 to 1.2 mm or more. Further, laser peening results in minimal cold work on the surface, and does not induce increased hardness.

The club face embodiment shown does not include grooves in the impact area of the ball striking face, as is typical for drivers. The grooves are put into clubs to spin stabilize the ball in flight. However, in the large drivers they are not able to put the grooves in the hitting area because the grooves are stress risers, even for shallow grooves, and the stress risers lead to fatigue failure.

Deep stress induced as described herein would put a protective layer deeper than the depth of the grooves and thus prevent the cracking. Thus we can make more stable drivers that include grooves.

Figure 8:
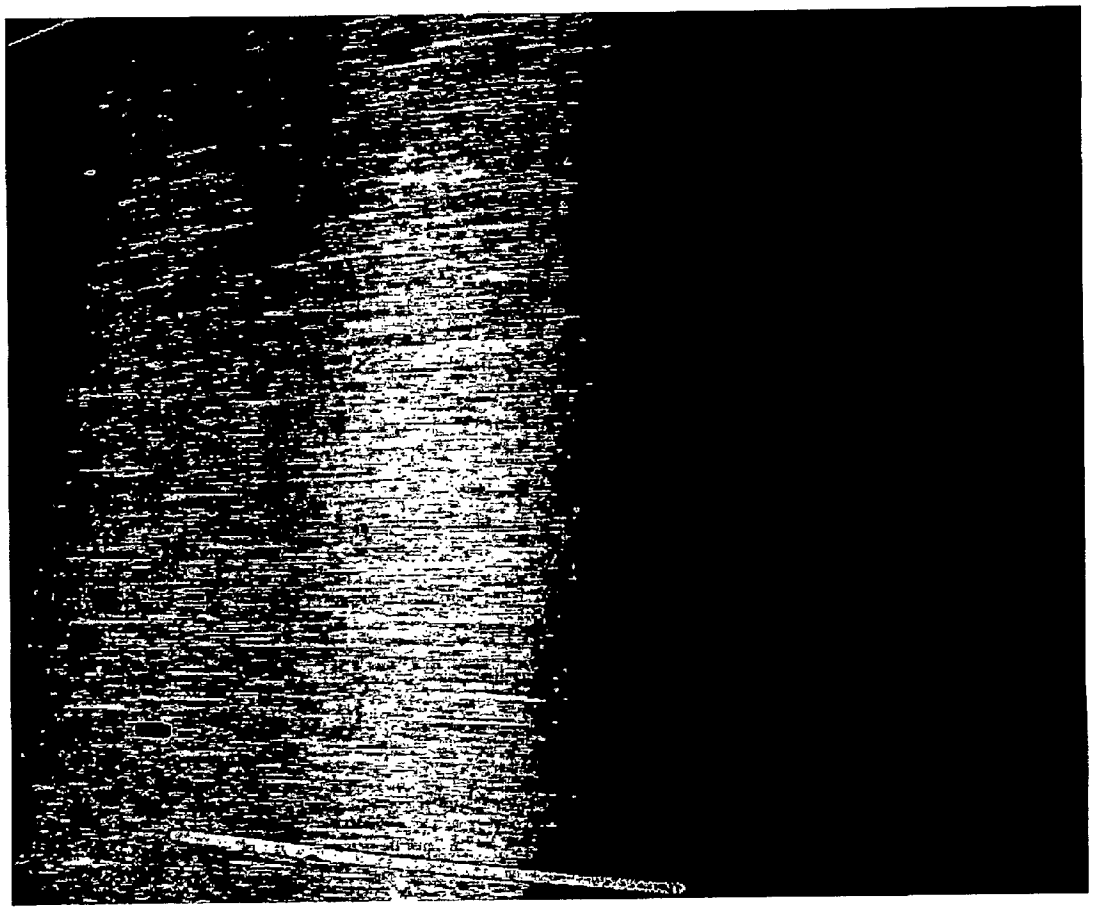
FIG. 8 is a photograph of an impact face after peening as described herein, on an assembled club head.

As illustrated in the photo of FIG. 8, the linear pattern of spots in the illustrated embodiment effectively puts in a set of lines on the order of microns deep, both in the horizontal and vertical directions and this potentially is the equivalent of grooves but ones that will not crack. It has been noticed in using the clubs peened as described herein, that they definitely are less prone to slicing or hooking the ball.

Figure 10:
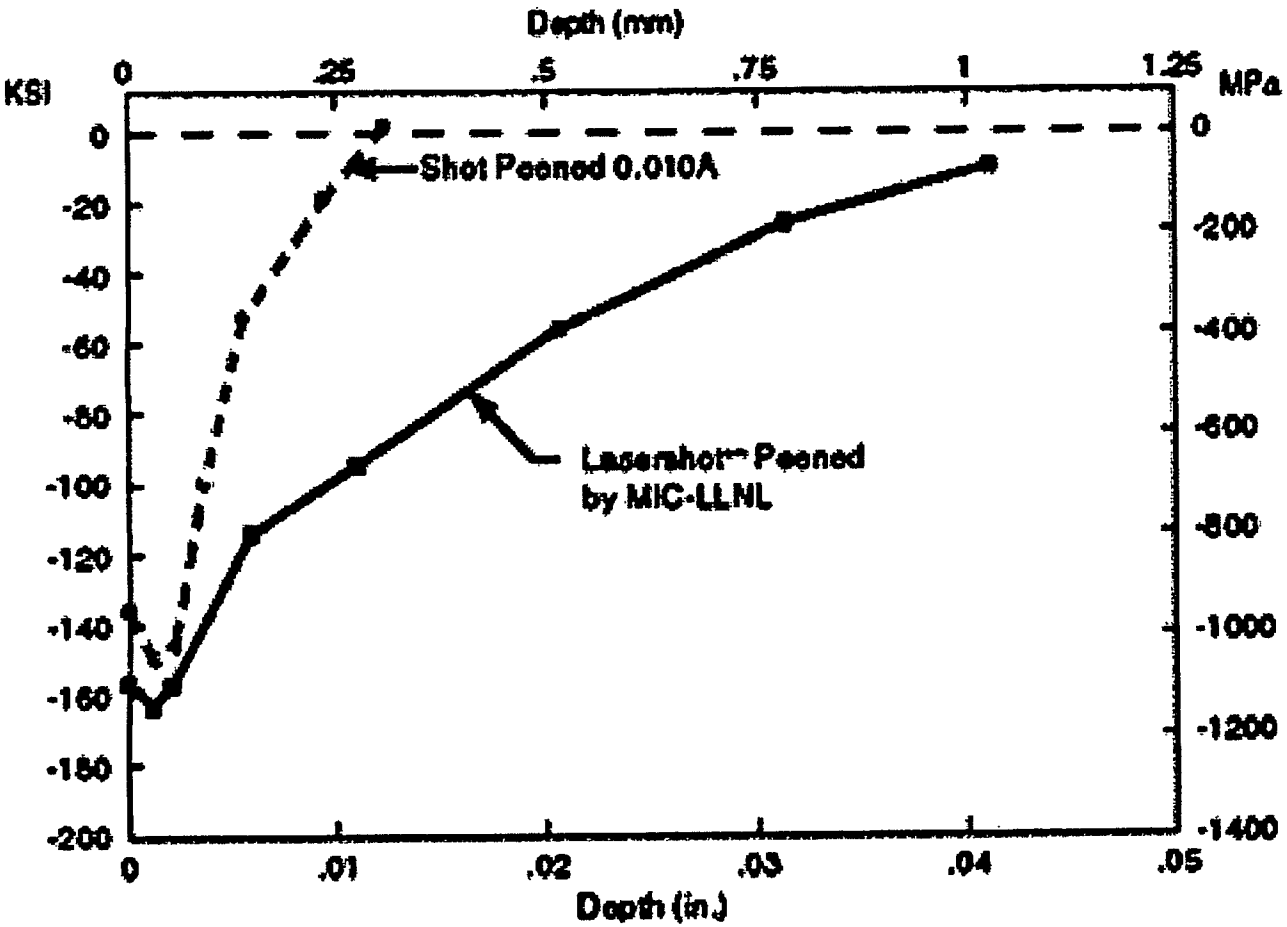
FIG. 10 is a graph comparing laser peening and shot peening with similar peak compressive stresses at the surface, for Inconnel.

The depth of stress and the integrated amount of compressive stress produced by laser peening distinguishes further over shot peening. FIG. 10 compares laser peening and shot peening in Inconnel, a high nickel alloy. This is fairly close to showing the difference between laser peening and shot peening with comparable peak intensity. You see that the peak intensity just near and below the surface are similar but the laser peened stress goes much deeper and has much more "area under the curve". To achieve this much "area under the curve" or depth of compressive stress with shot peening one would have the very heavily peen it and would result in a highly disturbed surface, in much cold work and thus a significant increase in surface hardness. The laser peened club face has a light rectangular pattern that is approximately a few microns in depth, without increased hardness relative to the unpeened area on the face, and without significant cold working.

Laser peening as described here puts down a defined, regular pattern of spots and shot peening is clearly a random process. Prior art U.S. Pat. No. 5,487,543 by Funk describes using a shot size of MI-170 means 0.017 inch nominal diameter shot. In metric units that is 0.4 mm shot, or roughly ten times smaller in size and 100 times smaller in area than the spot size used in the example above. If a larger shot size were used, the shot would get so large and thus massive that he would dent up the club. Also shot peening impact is spherical and the laser peening described herein is blunt, that is a square uniform intensity pressure pulse. The laser peening described herein goes in a few tens of nanoseconds and his goes in microseconds to milliseconds—that is 3 to 6 orders of magnitude slower. To get 100 percent coverage with his random, round spots hitting the surface, he needs, in this random process to cover some areas as much as 8 times, and still there is a finite probability of less than 100% coverage in some areas. To get 100% coverage the laser peening described herein needs to hit each area once and only once. Twice as used in the example described above provides 200% coverage. Three layers of peening results in 300% coverage and so on.

The technique can be applied to drivers or "woods" manufactured using hollow metal club heads, after assembly of the club head, or on a club face plate before assembly. The technique can be applied to irons as well, and particularly long irons.

Figure 7:
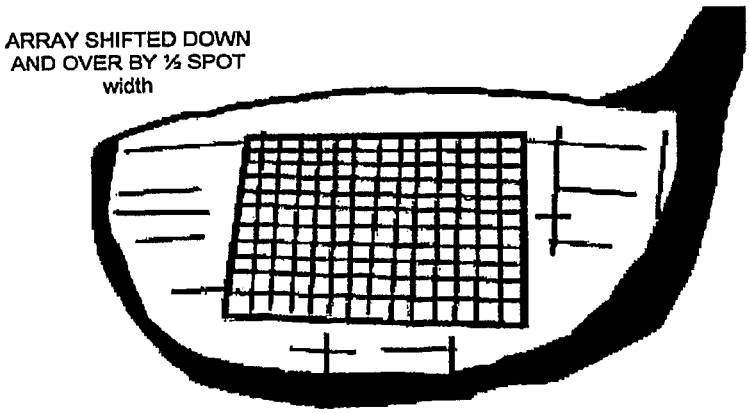
FIG. 7 is a drawing of a second array of peened spots on an ablative tape layer on an assembled club head, intended to illustrate that the array is shift down and over by one half spot size.

An example process for peening a club head using a system like that described above is described. First, the surface of the club is wiped with acetone to clean off any dirt, adhesive or anything left from packaging. Then it is wiped with alcohol to remove any residue of acetone. Next we apply a first layer of tape and a second layer of tape as shown in the FIG. 6—this provides a protective layer to keep from tarnishing the surface in case the first layer is breached by the peening pulse. Now the laser is set up for peening. The energy is adjusted to 16 J per pulse at the laser/club interaction point. The laser energy is absolutely calibrated with a calorimeter on a regular schedule and this is referred to a relative calorimeter that constantly monitors the laser energy. The pulse duration at 18 ns by looking at the output pulse shape on a fast oscilloscope. 18 ns is set at the full width of the pulse at half of maximum amplitude—the pulse looks something like a Gaussian (bell) shaped curve, although the rising edge of the pulse is much steeper due to the stimulated Brillioun scattering used within the laser amplifier. In order to have 6 GW/cm$^2$ irradiance at the target we set the spot size on a side at that target to be x=Sqrt((16 J/18 ns)/6 GW/cm$^2$)=0.385 cm. The spot size is set by taking advantage of the fact that the laser in this embodiment is coming to a focus with an F number of about 1.9. Thus the beam is getting smaller as one goes further away from the final lens. The target is moved closer to or further away from this lens until the beam is of the desired size. The spot is actually an image of reduced area of the output near field intensity profile of the laser. The spot size can be checked using paper sensitized to show a "burn" when the laser light hits it, and physically measuring the size of the burn. With the first two parameters set and spot size correct, an array of laser shock peened impact zones is caused on the golf club, by turning on the water for the tamping layer and putting down one pulse after another moving the beam from spot position to spot position. Referring to photo in FIG. 6, you can see a peening pattern of 10 rows and 14 columns with the ablative tape layer still in place after the first layer of peening—this is 6-18-1. The tape layer is removed, another tape layer is put on the club face as shown in FIG. 7, and then the club is laser shock peened again, moving the pattern of spots over by d=0.385 cm/2 cm and down by the same amount. When this second layer is peened we now have peened the golf club at 6-18-2.

The 6 GW/cm$^2$ represents the power density of the laser energy on the target. The larger this value, the greater the energy deposited and thus the higher the pressure in the shock wave and the more intense and the deeper the peening. The pulse duration, 18 ns in this embodiment, represents how long the laser energy is being delivered. The shock pressure lasts about twice as long as the laser pulse duration. When the pulse arrives at the target, a shock wave is generated within 1 ns and begins to travel through the ablative layer and into the golf club face compressing the material as it propagates. It propagates at the speed of sound into the material, at a speed of about 5000 m/s. When the pulse ends after about 18 ns, the plasma will start to cool and the pressure drop in about 36 ns. This drop in pressure, also propagates into the metal but it is now propagating in material that has been densified by the shock wave and will travel faster. It can eventually catch up to the initial shock wave and results in the shock front being dissipated. If the pulse duration is too short, the dissipation occurs at a shallower depth and the resulting depth of compressive stress is not sufficient. If the pulse duration is set longer, more energy is required out of the laser to keep the irradiance at the same 6 $GW/cm^2$ level. A higher energy laser is more difficult and more expensive to build. One layer of peening with an 18 ns pulse duration, puts in a good intensity and depth of compressive stress and produces improvements in characteristic time.

Another important factor is the spot size. The spot size determines the physical extent of the pressure pulse generated for doing the peening. But as the pulse propagates into the metal, the fact that the spot is of finite size "propagates" in from the edges, rarefying the intensity from the edges toward the middle of the shock spot. So the spot is effectively getting smaller at the same rate it is propagating into the material. In laser peening we typically want the shock to penetrate a mm or more so we are best to make the spot size reasonably greater than 1 mm on a side. Thus if one peens with a laser energy of 1 J rather than 16 J, the spot size has to decrease by a factor of square root of 16, that is by 4 times. Square spot sizes from about 1.0 to about 4.0 mm on a side are representative of sizes expected to produce results, with spot sizes having areas greater than 9 $mm^2$ preferred.

By peening only one side, stretch of the club face is minimized; and some curvature is added; and probably importantly, the front surface is left with a much higher level of compressive stress than the back face. A significant imbalance in stress results with the front face being more highly compressive.

The club face embodiment shown does not include grooves in the impact area of the ball striking face, as is typical for drivers. The grooves are put into clubs to spin stabilize the ball in flight. However, in the large drivers they are not able to put the grooves in the hitting area because the grooves are stress risers, even for shallow grooves, and the stress risers lead to fatigue failure.

Deep stress imparted as described herein, would put a protective layer deeper than the depth of the grooves and thus prevent the cracking. Thus one can make more stable drivers that include grooves.

As illustrated in the photo of FIG. 8, the linear pattern of spots in the illustrated embodiment effectively puts in a pattern of minimal deformation of the surface, in the form of a set of lines on the order of microns deep, both in the horizontal and vertical directions and this potentially is the equivalent of grooves but ones that will not crack due to the imparted compressive stress. It has been noticed in using the laser peened clubs that they definitely are less prone to slicing or hooking the ball.

The depth of stress and the integrated amount of compressive stress produced by laser peening distinguishes further over shot peening. FIG. 10 compares laser peening and shot peening in Inconnel, a high nickel alloy. This is fairly close to showing the difference between laser peening and shot peening with comparable peak intensity. One can see that the peak intensities just near and below the surface are similar but the laser peened stress goes much deeper and has much more "area under the curve". To achieve this much "area under the curve" or depth of compressive stress with shot peening one would have the very heavily peen it and would result in a highly disturbed surface, in much cold work and thus a significant increase in surface hardness. The laser peened club face has a light rectangular pattern that is approximately a few microns in depth, without increased hardness relative to the unpeened area on the face, and without significant cold working.

Experiments have been conducted using club heads for metal woods having machined titanium face plates with an average thickness of about 3 mm. the face plates have raised areas on the center of the back surface in approximately the shape of a parallelogram with rounded corners. The vertical faces of the parallelogram are canted towards direction of the shaft. The face plate is about 1.5 mm thicker at the raised center for a total about 4.5 mm. A number of patterns were tested, including those shown in FIGS. 11, 12, 13A, 13B, 14A and 14B.

In these experiments, the spot size of the laser beam used for inducing the laser shock peened impact zones is square with sides measuring 3.85 mm (area greater than 14 $mm^2$). The array of impact zones includes squares within the grid that measure 3.47 mm on a side. This results in a 5% overlap between each spot and its neighbors on all four sides. As shown in the Figures, a grid of 19×31 squares is overlaid on an image of the club face, and the selected locations for the zones in an array of laser shock peened impact zones are highlighted according to the pattern applied.

Figure 11:
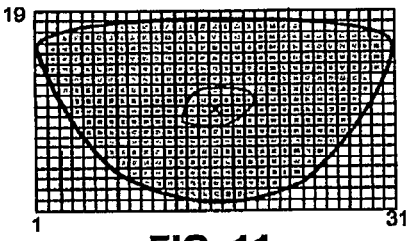
FIG. 11 illustrates a pattern for an array of laser shock peening impact zones for an embodiment in which the pattern covers substantially all of the club face.

FIG. 11 illustrates a pattern in which the array of laser shock peened impact zones covers substantially the entire face of the club. The position of the raised center on the back of the club face is indicated by the trace 500. In one example, a single array of 374 spots essentially covers the club face. A second array layout essentially covering the club face includes 367 spots.

Figure 12:
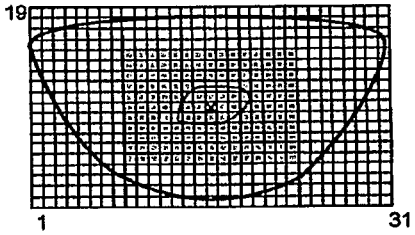
FIG. 12 illustrates a rectangular pattern for an array of laser shock peening impact zones in which the perimeter of the club face is not peened.

FIG. 12 illustrates a rectangular pattern in which the array of laser shock peen impact zones measures 11×15 squares (165 spots), leaving a perimeter region on the club face which is not peened. In this pattern, the impact area of the club intersects with, and is substantially covered by, the array of impact zones. Also, the array of impact zones causes a residual compressive stress in the interior area that is much greater than that in the perimeter area. Therefore, the perimeter area can be said to have an amount of residual compressive stress less than that of the interior area.

The club face can be characterized by falling within a rectangular area defined by outermost projections of a crown, a sole, a heel and a toe of the club head. In the illustrations shown, the grid of 19×31 squares would be reduced by about one row and one column to define this hypothetical rectangular area resulting in an 18×30 square grid, having 540 spots. As can be seen, the pattern of FIG. 12 covers less than about one half of the club face, and less than about one-third of the rectangular area.

Figure 13A:
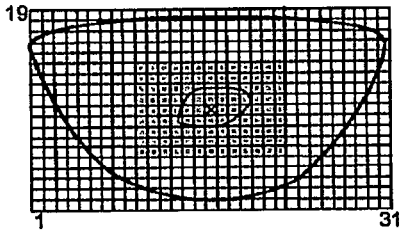
FIGS. 13A and 13B illustrate reduced size rectangular patterns for an array of laser shock peening impact zones used for a first peening layer and for a second peening layer respectively.
Figure 13B:
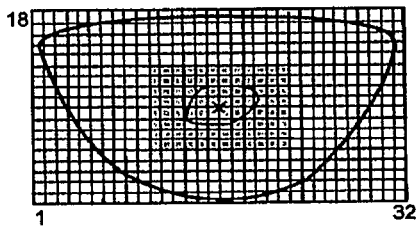

FIG. 13A illustrates a smaller rectangular pattern in which the array of laser shock peen impact zones measures 9×13 squares (117 spots), leaving a perimeter region on the club face which is not peened. An alternative array layout for a smaller rectangular pattern used as a second layer with the pattern of FIG. 13A is shown in FIG. 13B, and measures about 8×12 squares (96 spots). These patterns cover less than one third of the club face and less than about 25% of the rectangular area.

Figure 14A:
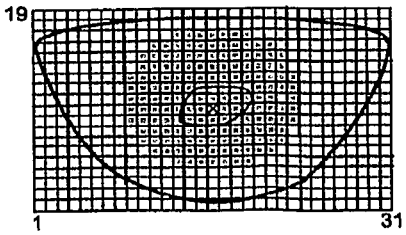
FIGS. 14A and 14B illustrate an oval pattern for an array of laser shock peening impact zones having about the same number of impact zones as the pattern of FIG. 12, used for a first peening layer and a second peening layer respectively.
Figure 14B:
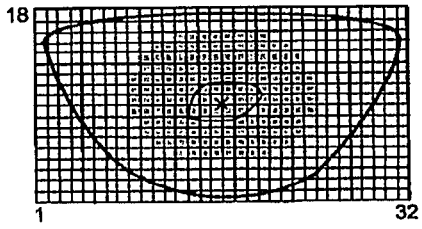

FIG. 14A illustrates an oval pattern having about 163 spots, similar in size to the rectangular pattern of FIG. 12. FIG. 14B illustrates an alternative array layout for a smaller oval pattern used as a second layer with the pattern of FIG. 14A having 160 spots. As can be seen, the patterns of FIGS. 14A and 14B cover less than about one half of the club face, and less than about one-third of the rectangular area.

The patterns shown in FIGS. 11, 12, 13A, 13B, 14A and 14B were laser shock peened with the laser having a pulse duration of about 18 ns and a per pulse energy of 16 J, resulting in a peak irradiance of 6 $GW/cm^2$ with a square spot measuring 3.85 mm on a side. Two layers of aluminum tape were applied over the surface to be peened before applying the pattern of laser shock peen impact zones, as discussed above. The golf clubs were laser shock peened according to the patterns described above and a characteristic time CT measurement was made according to the specifications set forth in "PROCEDURE FOR MEASURING THE FLEXIBILITY OF A GOLF CLUBHEAD", United States Golf Association, revision 2.0, Mar. 25, 2005. The apparatus uses a pendulum with a hemispherical steel striker that has the radius of the standard golf ball. An accelerometer attached to the striker measures the dynamics of the collision between it and the face of the club. The pendulum is dropped onto the club face surface from three different heights, yielding three different impact velocities. These heights are set by detents built and to the pendulum release mechanism. Raw accelerometer data was filtered to remove spurious resonances and produce data as shown in FIG. 15.

Figure 15:
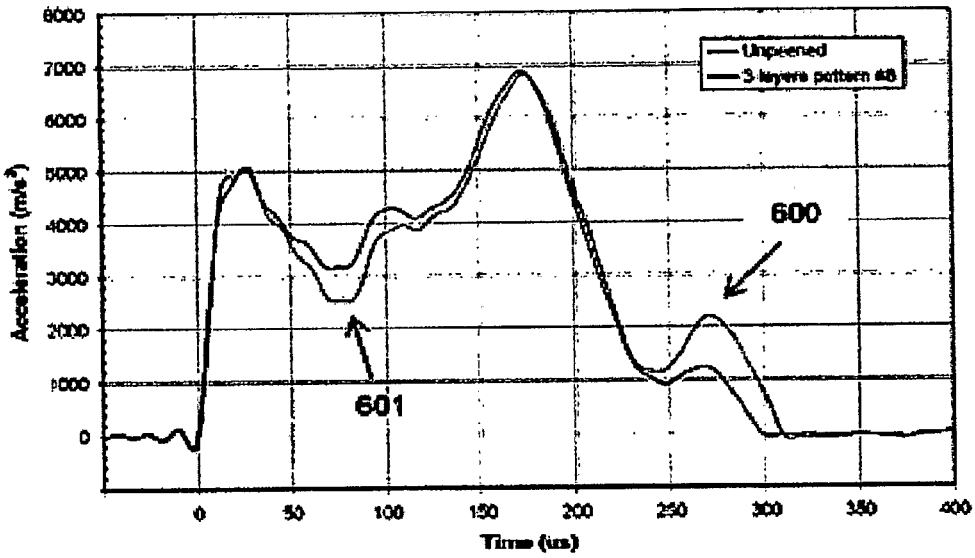
FIG. 15 is a graph showing filtered accelerometer data showing dynamics of a collision between a striker on a pendulum and the club face in an experiment conducted to measure the characteristic time CT according to USGA specifications for an embodiment laser peened using the pattern of FIG. 12, and an un-peened embodiment.

FIG. 15 is a graph of acceleration versus time, showing in filtered acceleration curves for a golf club before peening, and after applying three layers according to the oval pattern shown in FIGS. 14A and 14B. As can be seen, the curves are qualitatively similar. However there is a significant difference in the trailing edge of the curves. On both curves, there is a final peak of acceleration in the region 600 just before the pendulum striker loses contact with the face of the club. However, for the peened club, this final peak of acceleration is about 40% smaller in amplitude. Likewise, the dip in acceleration in the region 601 is significantly deeper for the unpeened club.

Figure 16:
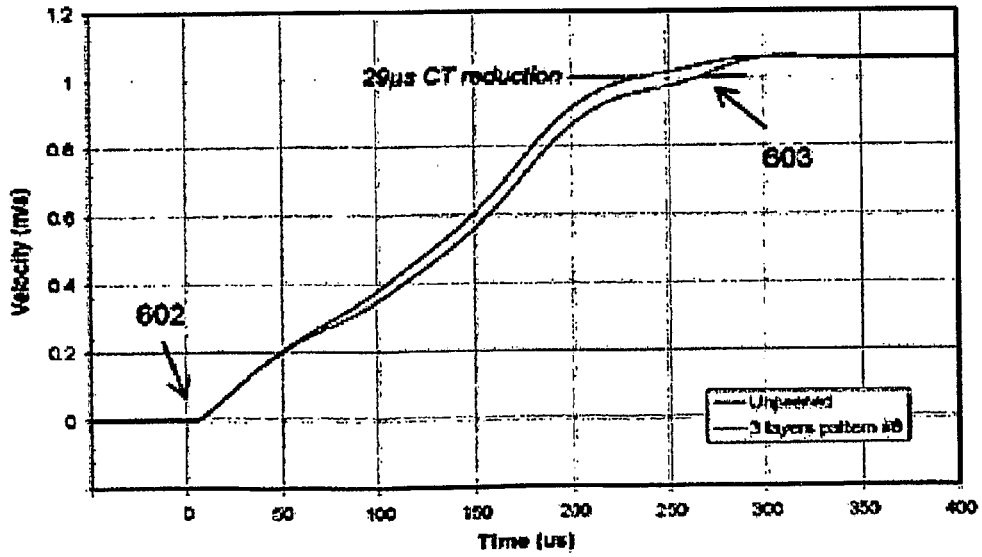
FIG. 16 is a graph showing the integrated results of the accelerometer data shown in FIG. 15.

FIG. 16 is a graph of velocity versus time produced by integrating the acceleration data of FIG. 15 for both the unpeened club and the peened club. This represents the change in pendulum striker speed over the course of the impact with the club face. The highest point on the curve is the total velocity change. Note that in the fixed coordinate frame of the testing apparatus, zero velocity would actually fall somewhere in the middle of vertical range, not at the base line as the plot shows. The characteristic time is calculated by measuring the duration of the step in velocity change. The slope of the waveform is small near the beginning and end of the waveform. So to avoid uncertainties when trying to determine the precise start and stop points, the characteristic time is defined as the time between the 5% and 95% points 602, 603 on the curve. As illustrated in the figure, the reduction in characteristic time achieved by laser peening in this example is 29 μs.

Figure 17:
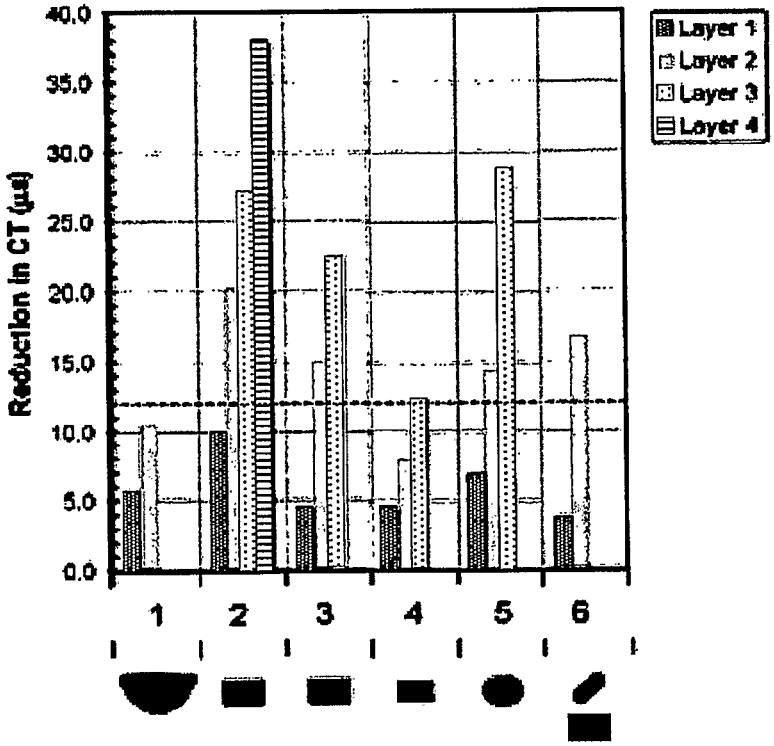
FIG. 17 is a bar graph summarizing the amount of reduction in characteristic time CT achieved for various examples where the pattern and number of layers of laser shock peening were varied.

Although a number of combinations of patterns were tested, the results on six representative clubs are presented in Table I, showing unexpected and surprising results achieved by the laser shock peening technology described here. In the Table, the first column identifies the club, the second column shows the measured characteristic time before peening (Start CT), columns 3 through 6 show characteristic time measurements after each layer of peening (Layer 1 CT, Layer 2 CT, Layer 3 CT, Layer 4 CT). The last columns in the table show the change in characteristic time measurements, compared to the starting characteristic time after each layer of peening. FIG. 17 is a graphical summary of the reduction in characteristic time before the six representative club heads. The dashed line at 12 μs is an arbitrary reference, emphasizing the surprising and unexpected differences among the patterns.

For the first club, peened over substantially the entire face, after two layers the reduction in characteristic time was about 10.5 μs. In contrast, for the second club peened with the rectangular pattern leaving a perimeter unpeened, but covering a substantial portion of the club face, the reduction in characteristic time after two layers was over 20 μs. After four layers of laser shock peening, reduction in characteristic time was 37.7 μs. Similar results were achieved in club 3 where the reduction in characteristic time after the second layer was 14.9 μs and after the third layer was 22.6 μs. The oval pattern of club 3 may be preferred for aesthetic reasons, and seems to provide results as good or better than the other patterns. In club 4, in which the smaller rectangular pattern was applied, significantly less reduction in characteristic time was achieved. In fact, the results for the fourth club showed a smaller reduction in the characteristic time than achieved in the first club in which substantially the entire club face was peened. The fifth club was peened using the oval pattern. As can be seen, the results using the oval pattern compare with those of the second club with a reduction in characteristic time after three layers of 28.9 μs. The sixth club in this example was peen using a slanted oval pattern as illustrated below the bars in FIG. 17, followed by a rectangular pattern. As can be seen, after applying the rectangular pattern the reduction in characteristic time was substantial, even though the first pattern applied did not cover the same area. Tests not summarized here using two layers of the smaller slanted oval patterns resulted in a reduction in characteristic time as well, accomplishing results similar to those achieved with two layers of the small rectangle as shown in the data for the fourth club.

Surface stress was measured for a club face peened with one layer, two layers and three layers, showing over 400 MPa stress after one layer (about 450 MPa), over 600 MPa stress after two layers (about 630 MPa) and then a reduction after three layers to about 450 MPa. The residual stress in the surface at over 400 MPa is much higher than anticipated in the prior art, and the reduction in surface residual stress after three layers suggests that an important parameter is deep compressive stress penetrating Therefore, these test results demonstrate that it is desirable to apply multiple layers of peening over a portion of the club face, leaving a stress gradient in the club face. The club face has high intensity compressive stress at depths much greater than anticipated in the prior art without damage to the surface, and without significant clubface hardening. The spot sizes used are also much greater than anticipated in the prior art, further contributing to a greater depth of compressive stress, and leaving a pattern of minimal deformation of the surface of the club face. The test results suggests that it is desirable to peen a pattern covering more than one third, and less than all of the club face, and that applying multiple layers improves the results.

Figure 18:
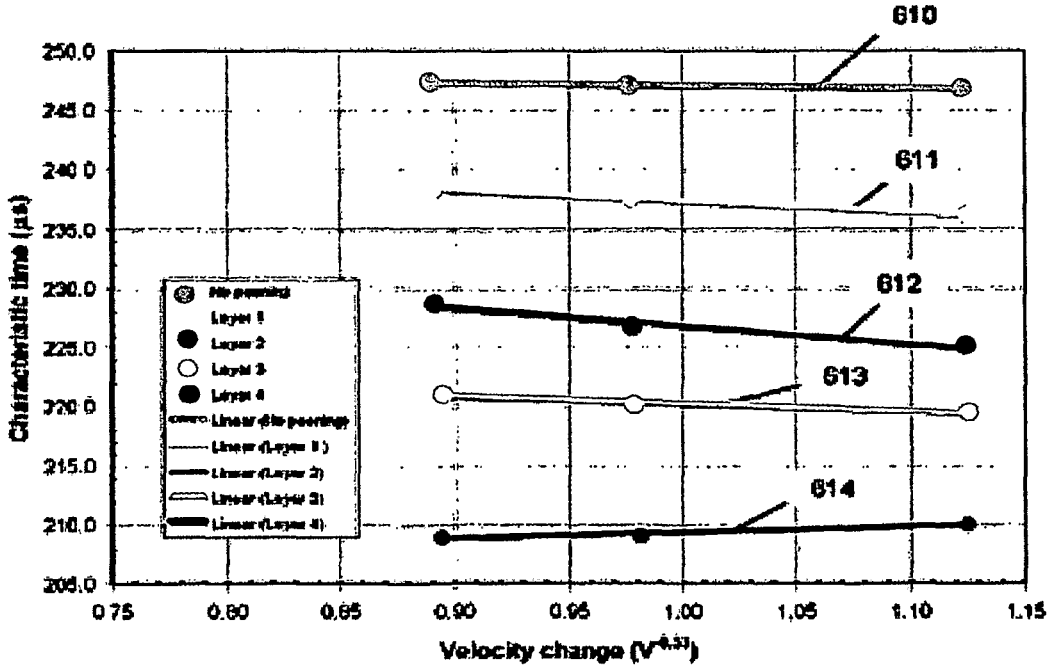
FIG. 18 is a graph of characteristic time in microseconds versus velocity change showing changes in characters to time measurements for various impact speeds.

FIG. 18 is a graph of characteristic time versus velocity change ($V^{-0.33}$) for the three set heights according to the USGA standard for the second club in which the rectangular patterns were applied. There is not a large variation in the CT measurements for the three different pendulum heights, even though the pendulum velocity change varies from about 0.7 to about 1.4 m/sec from the lowest to the highest release height. However, the USGA provides a specification for maximum allowable change. In particular, there is a requirement that the measured characteristic time in microseconds versus pendulum velocity in meters per second raised to the negative 0.33 power should not have a slope greater than a threshold of 20.

This requirement seems linked primarily to regulate club heads that may have applied coatings. For the unpeened club head shown on trace 610, the measured slope is −2.0. After one layer as shown on trace 611, the slope is −8.6. After two layers as shown on trace 612, the slope is −14.6. After three layers as shown on trace 613, the slope is −6.3. After four layers as shown on trace 614, the slope is 5.0. Therefore, the CT slope of club heads treated as described herein did not approach the limits imposed by the USGA in this example.

Figure 19:
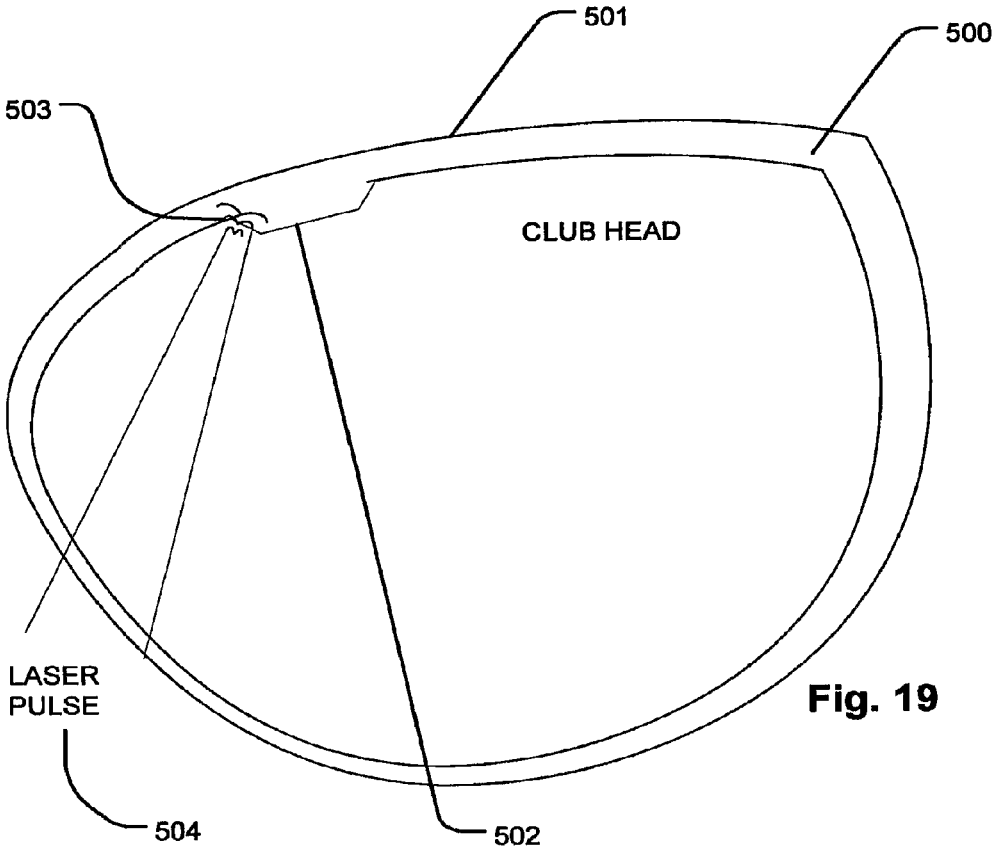
FIG. 19 illustrates laser peening an inside surface of the club face of an assembled, metal club head.

FIG. 19 is a simplified diagram showing laser peening of the back surface of a club face on a stress riser. In particular the club head 500 has a club face 501 with a back surface. At raised feature 502 is included on the back surface in the impact zone. The sides of the raised feature, such as side 503, act as a stress riser, and can be a location in which cracks could occur, reducing the useful life of the club. Applying high-intensity laser peening as described herein and indicated by pulse 504; on the stress riser reduces the likelihood of such cracks. Although shown in an assembled form in the Figure for perspective, laser shock peening the back side of the club face is done before assembly of the club head.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

What is claimed is:

1. A method of manufacturing a golf club, comprising a club head having a club face, comprising:

inducing residual compressive stress by laser shock peening to form an array of laser shock peened impact zones according to a pattern covering at least a fractional portion of the club face, wherein the array of laser shock impact zones have residual compressive stress penetrating to a depth of more than 0.2 millimeters.

2. The method of claim 1, wherein the array of laser shock impact zones have residual compressive stress penetrating to a depth of more than 0.4 millimeters.

3. The method of claim 1, wherein the array of laser shock impact zones have residual compressive stress penetrating to a depth of more than 0.8 millimeters.

4. The method of claim 1, wherein the club face includes an impact area, and the pattern covers at least a portion of the impact area.

5. The method of claim 1, wherein the golf club is a wood.

6. The method of claim 1, wherein the golf club is a driver.

7. The method of claim 1, wherein the club face is characterized by falling within a rectangular area defined by outermost projections of a crown, a sole, a heel and a toe of the club head, and wherein the pattern covers less than about one-half of the rectangular area.

8. The method of claim 1, wherein the club face is characterized by falling within a rectangular area defined by outermost projections of a crown, a sole, a heel and a toe of the club head, and wherein the pattern covers less than about one-third of the rectangular area.

9. The method of claim 1, wherein the array of laser shock impact zones covers less than all of the club face, and more than one third of the club face.

10. The method of claim 1, wherein the pattern has a substantially rectangular shape.

11. The method of claim 1, wherein the pattern has a substantially oval shape.

12. The method of claim 1, wherein the impact zones having respective areas greater than 1 $mm^2$.

13. The method of claim 1, wherein the impact zones having respective areas greater than 9 $mm^2$.

14. The method of claim 1, wherein the club face includes a regular pattern of grooves, and the pattern overlaps with the regular pattern of grooves.

15. The method of claim 1, wherein the pattern covers a stress riser in the fractional portion of the club face.

16. The method of claim 1, including applying said laser shock peening on an assembled club head.

17. A method of manufacturing a golf club, comprising a club head having a club face, comprising:

inducing residual compressive stress by laser shock peening to form an array of laser shock peened impact zones according to a pattern covering at least a fractional portion of the club face, wherein the club face has an outside surface, a perimeter area on the outside surface and an interior area on the outside surface within and surrounded by the perimeter area, the pattern covering only the interior area.

18. A method of manufacturing a golf club, comprising a club head having a club face, comprising:

inducing residual compressive stress by laser shock peening to form an array of laser shock peened impact zones according to a pattern covering at least a fractional portion of the club face, wherein the club face has an outside surface, a perimeter area on the outside surface and an interior area on the outside surface within the perimeter area; the pattern inducing a stress gradient between the interior area and the perimeter area.

19. A method of manufacturing a golf club, comprising a club head having a club face, comprising:

inducing residual compressive stress by laser shock peening to form an array of laser shock peened impact zones according to a pattern covering at least a fractional portion of the club face, including laser shock peening the club face to form a first array of impact zones according to the pattern and to form a second array of impact zones, the second array overlapping the first array.

20. A method of manufacturing a golf club, comprising a club head having a club face, comprising:

inducing residual compressive stress by laser shock peening to form an array of laser shock peened impact zones according to a pattern covering at least a fractional portion of the club face, wherein the club face comprises a material which in the portion of the club face covered by the pattern, is not significantly harder than the material without residual compressive stress.

21. A method of manufacturing a golf club, comprising a club head having a club face, comprising:

inducing residual compressive stress by laser shock peening to form an array of laser shock peened impact zones according to a pattern covering at least a fractional portion of the club face, including laser shock peening with laser pulses having irradiance greater than 1 $GW/cm^2$, with a spot size sufficient to cause impact zones greater than 1 $mm^2$.

22. The method of claim 21, including laser shock peening with laser pulses having irradiance greater than 4 $GW/cm^2$, with a spot size sufficient to cause impact zones greater than 4 $mm^2$.

23. A method of manufacturing a golf club, comprising a club head having a club face, comprising:

inducing residual compressive stress by laser shock peening to form an array of laser shock peened impact zones according to a pattern covering at least a fractional portion of the club face, including laser shock peening with laser pulses having irradiance greater than 4 $GW/cm^2$.

24. A method of manufacturing a golf club, comprising a club head having a club face, comprising:

inducing residual compressive stress by laser shock peening to form an array of laser shock peened impact zones according to a pattern covering at least a fractional portion of the club face, including laser shock peening to form a first array of adjacent, laser shock impact zones having a substantially uniform width according to the pattern on the club face; and laser shock peening including forming a second array of adjacent, non-overlapping laser shock impact zones within the pattern on the club face, wherein the locations of the first array of laser shock impact zones are offset relative to locations of laser shock impact zones in the second array by less than said substantially uniform width.

25. A golf club, comprising:

a club head including a club face, and the club face including an array of laser shock peened impact zones in a pattern covering at least a fractional portion of the club face, wherein the array of laser shock impact zones have residual compressive stress penetrating to a depth of more than 0.2 millimeters.

26. The golf club of claim 25, wherein the array of laser shock impact zones have residual compressive stress penetrating to a depth of more than 0.4 millimeters.

27. The golf club of claim 25, wherein the array of laser shock impact zones have residual compressive stress penetrating to a depth of more than 0.8 millimeters.

28. The golf club of claim 25, wherein the club face includes an impact area, and the pattern covers at least a portion of the impact area.

29. The golf club of claim 25, wherein the golf club is a wood.

30. The golf club of claim 25, wherein the golf club is a driver.

31. The golf club of claim 25, wherein the club face is characterized by falling within a rectangular area defined by outermost projections of a crown, a sole, a heel and a toe of the club head, and wherein the first volume of residual compressive stress covers less than about one-half of the rectangular area.

32. The golf club of claim 25, wherein the club face is characterized by falling within a rectangular area defined by outermost projections of a crown, a sole, a heel and a toe of the club head, and wherein the first volume of residual compressive stress covers less than about one-third of the rectangular area.

33. The golf club of claim 25, wherein the array of laser shock impact zones covers less than all of the club face, and more than one third of the club face.

34. The golf club of claim 25, wherein the pattern has a substantially rectangular shape.

35. The golf club of claim 25, wherein the pattern has a substantially oval shape.

36. The golf club of claim 25, wherein the impact zones have respective areas greater than 1 $mm^2$.

37. The golf club of claim 25, wherein the impact zones have respective areas greater than 9 $mm^2$.

38. The golf club of claim 25, wherein the club face comprises a material which in the portion of the club face covered by the first volume, is not significantly harder than the material without residual compressive stress.

39. The golf club of claim 25, including a stress riser in the fractional portion of the club face.

40. A golf club, comprising:

a club head including a club face, and the club face including an array of laser shock peened impact zones in a pattern covering at least a fractional portion of the club face, wherein the club face has an outside surface, a perimeter area on the outside surface and an interior area on the outside surface within the perimeter area;

and wherein residual compressive stress in the array of impact zones contributes to a stress gradient between the interior area and the perimeter area.

41. A golf club, comprising:

a club head including a club face having an front surface including an impact area and a back surface, the back surface of the club face including stress riser, and wherein the club face includes a first volume having residual compressive stress penetrating to a depth of more than 0.2 mm, and covering a fractional portion of the back surface of the club face on or near the stress riser.

* * * * *